US009408762B1

(12) United States Patent
Baker

(10) Patent No.: US 9,408,762 B1
(45) Date of Patent: Aug. 9, 2016

(54) DRIVE SYSTEM FOR A WHEELCHAIR

(71) Applicant: Scott Bradley Baker, Sherman Oaks, CA (US)

(72) Inventor: Scott Bradley Baker, Sherman Oaks, CA (US)

( * ) Notice: Subject to any disclaimer, the term of this patent is extended or adjusted under 35 U.S.C. 154(b) by 0 days.

(21) Appl. No.: 14/286,804

(22) Filed: May 23, 2014

Related U.S. Application Data

(63) Continuation-in-part of application No. 14/261,343, filed on Apr. 24, 2014, now abandoned, which is a continuation of application No. 14/151,631, filed on Jan. 9, 2014, now abandoned, which is a continuation of application No. 14/029,138, filed on Sep. 17, 2013, now abandoned, which is a continuation-in-part of application No. 13/134,888, filed on Jun. 20, 2011, now Pat. No. 8,540,266, which is a continuation-in-part of application No. 12/315,548, filed on Dec. 4, 2008, now Pat. No. 7,963,539.

(60) Provisional application No. 61/005,439, filed on Dec. 5, 2007, provisional application No. 61/005,446, filed on Dec. 5, 2007, provisional application No. 61/005,447, filed on Dec. 5, 2007.

(51) Int. Cl.
*A61G 5/02* (2006.01)
*A61G 5/08* (2006.01)

(52) U.S. Cl.
CPC ..... *A61G 5/023* (2013.01); *A61G 5/025* (2013.01); *A61G 5/08* (2013.01); *A61G 2005/0883* (2013.01)

(58) Field of Classification Search
CPC ..... A61G 5/02; A61G 5/023; A61G 5/025
See application file for complete search history.

(56) References Cited

U.S. PATENT DOCUMENTS

| | | | | |
|---|---|---|---|---|
| 4,840,076 | A * | 6/1989 | Brubaker et al. | 74/143 |
| 4,865,344 | A * | 9/1989 | Romero et al. | 280/255 |
| 5,609,348 | A * | 3/1997 | Galumbeck | 280/250.1 |
| 5,865,455 | A * | 2/1999 | Taylor | 280/250.1 |
| 6,173,986 | B1 * | 1/2001 | Sicher | 280/647 |
| 7,360,840 | B2 * | 4/2008 | Barlow et al. | 297/423.26 |
| 7,367,578 | B2 * | 5/2008 | Jansen | 280/304.1 |
| 2007/0052196 | A1 * | 3/2007 | Taylor | 280/250.1 |
| 2009/0295119 | A1 * | 12/2009 | Bloswich et al. | 280/250.1 |
| 2010/0007114 | A1 * | 1/2010 | Papi et al. | 280/304.1 |
| 2013/0187355 | A1 * | 7/2013 | Slorance | 280/250.1 |

* cited by examiner

*Primary Examiner* — Tony Winner
(74) *Attorney, Agent, or Firm* — Coun P. Abrahams

(57) ABSTRACT

A wheelchair comprises a frame or chassis, a seat mounted on the chassis, a front wheel assembly mounted on the chassis, and a pair of rear wheels mounted on the chassis. A drive train assembly propels the wheelchair in a selectively forward or reverse direction. The drive train assembly comprises an arm lever which can be moved back and forth by the user, a drive member connected to the arm lever by means of a chain, and a rear wheel hub assembly connected to the drive member by means of a chain.

29 Claims, 44 Drawing Sheets

65
67
68
69
70
71
72
73
74
75
76
77
78
79
80
81
82
83
84
85
86
87
88
89
90
91
92
93
94
95
96
97
98
99
100
101
102
103
104
105
106

DRIVE SYSTEM FOR A WHEELCHAIR

CROSS REFERENCE TO RELATED APPLICATIONS

This application is a continuation application of U.S. Ser. No. 14/261,343 filed Apr. 24, 2014, which is a continuation of U.S. Ser. No. 14/151,631 filed Jan. 9, 2014, a continuation of U.S. Ser. No. 14/029,138 filed Sep. 17, 2013, a continuation of U.S. Ser. No. 13/134,888 filed Jun. 20, 2011, a continuation in part of U.S. Ser. No. 12/315,548 filed Dec. 4, 2008, which claims the benefit of Provisional Patent Application No. 61/005,439 filed Dec. 5, 2007, Provisional Patent Application No. 61/005,446 filed Dec. 5, 2007, and Provisional Patent Application No. 61/005,447 filed Dec. 5, 2007.

FIELD AND BACKGROUND OF THE INVENTION

This invention relates to a wheelchair. Particularly, the invention is for a wheelchair which is propelled by means of a drive mechanism, the drive mechanism including a pair of reciprocating arm levers connected through a drive train to the rear wheels of the wheelchair.

SUMMARY OF THE INVENTION

According to one aspect of the invention, there is provided a wheelchair comprising: a frame or chassis; a seat mounted on the chassis; a front wheel assembly mounted on the chassis; a pair of rear wheels mounted on the chassis; and a drive train assembly for propelling the wheelchair in a selectively forward or reverse direction, the drive train assembly comprising an arm lever which can be moved back and forth by the user, a drive member connected to the arm lever by means of a chain, and a rear wheel hub assembly connected to the drive member by means of a chain.

The frame or chassis may be generally constructed of a plurality of block pieces connected to each other by a plurality of tubes.

In one embodiment, the seat comprises a base, a seating surface, and a back member, the back member being pivotable relative to the base so as to facilitate folding and storage thereof. The back member may comprise a pair of adjustable pads whose position and orientation can be adjusted to suit the physical requirements of the user. In one form, a circular lock slot may be positioned between the base and the back, the lock slot being adjustable between the folded and unfolded position, and a lock stop operation member at the top of the back member.

Preferably, the front wheel assembly is pivotable relative to the frame or chassis so that it is movable between a folded position for storage and transportation and an unfolded position for use of the wheelchair. The front wheel assembly may comprise a frame member, a foot support, a pair of castor modules, and wheels attachable to the castor modules.

In one embodiment, the arm lever has a lower portion connected to the chassis, a sprocket at or near the lower portion, and an upper portion which extends above the level of the seat so as to be conveniently located for gripping by the user. The arm lever may further comprise an inwardly directed handle at its end remote from the sprocket, and cables extending within the arm lever from the handle to the hub assembly. Preferably, the handles comprise rotatable gear changers, rotation of which acts on the cables to change gears formed in the wheel hub assembly.

In one embodiment, the rear wheel hub comprises a forward ramp ring and reverse ramp ring, and an inner clutch for selective operative engagement with either the forward ramp ring or the reverse ramp ring. An inner clutch slider may be provided upon which the inner clutch is mounted, the inner clutch slider having a slot therein for receiving a shift pull post, the shift pull post being axially movable by operation of a cable to shift the inner clutch slider within the rear wheel hub. Furthermore, a cable may extend between the shift pull post and the arm lever such that a user by maneuvering the arm lever is able to vary the tension in the cable to move the inner clutch slider and the inner clutch so as to selectively rotate each of the rear wheels in either a forward or rearward direction.

In a further embodiment, the rear wheel hub has associated therewith a sprocket which is connected by means of a chain to the drive member. The drive member may have a first sprocket and a second sprocket which connects by means of a chain to the sprocket on the arm lever, and a second sprocket which connects to the sprocket on the wheel hub by means of a chain.

Preferably, the drive member comprises a torsion mechanism having a torsion housing, a pair of sprockets at each end of the torsion housing, the torsion housing being rotatably mounted on a torsion shaft, the pair of sprockets at each end of the torsion housing being respectively connected to the arm lever and the rear hub respectively.

In one form, each of the rear wheels comprises a pair of wheel plates, the wheel plates being connected to the rear wheel hub assembly. The wheel plates may be substantially flat disk shaped structures which are spaced at an inner portion thereof at the connection to the rear wheel hub assembly and taper towards each other and are connected at an outer portion thereof where the tire mounts.

Preferably, the wheelchair further comprises a braking mechanism. The braking mechanism comprises a disk connected to the rear wheel hub assembly and a caliper attached to the swing arm and containing brake pads for selectively engaging the disk, the brake pads being operated by a brake engagement lever.

Furthermore, the seat may comprise a base, a seating surface and a back member, the seating surface being ergonomically configured for the comfort of the user. Each of the front wheels may comprise a pair of wheels.

In yet a further embodiment, the wheelchair comprises a pair of bolsters for supporting the legs of the user, each bolster comprising a plate like structure movable between a first position in which the legs of the user are supported and contained and a second position in which each bolster is moved to a non-operational position so as to be out of the way to facilitate the user in mounting or dismounting the wheelchair.

BRIEF DESCRIPTION OF THE DRAWINGS

In the drawings:

FIG. 20 is a detail view showing the arm lever shaft and support area;

DESCRIPTION OF THE INVENTION AND DRAWINGS

Figure 1:
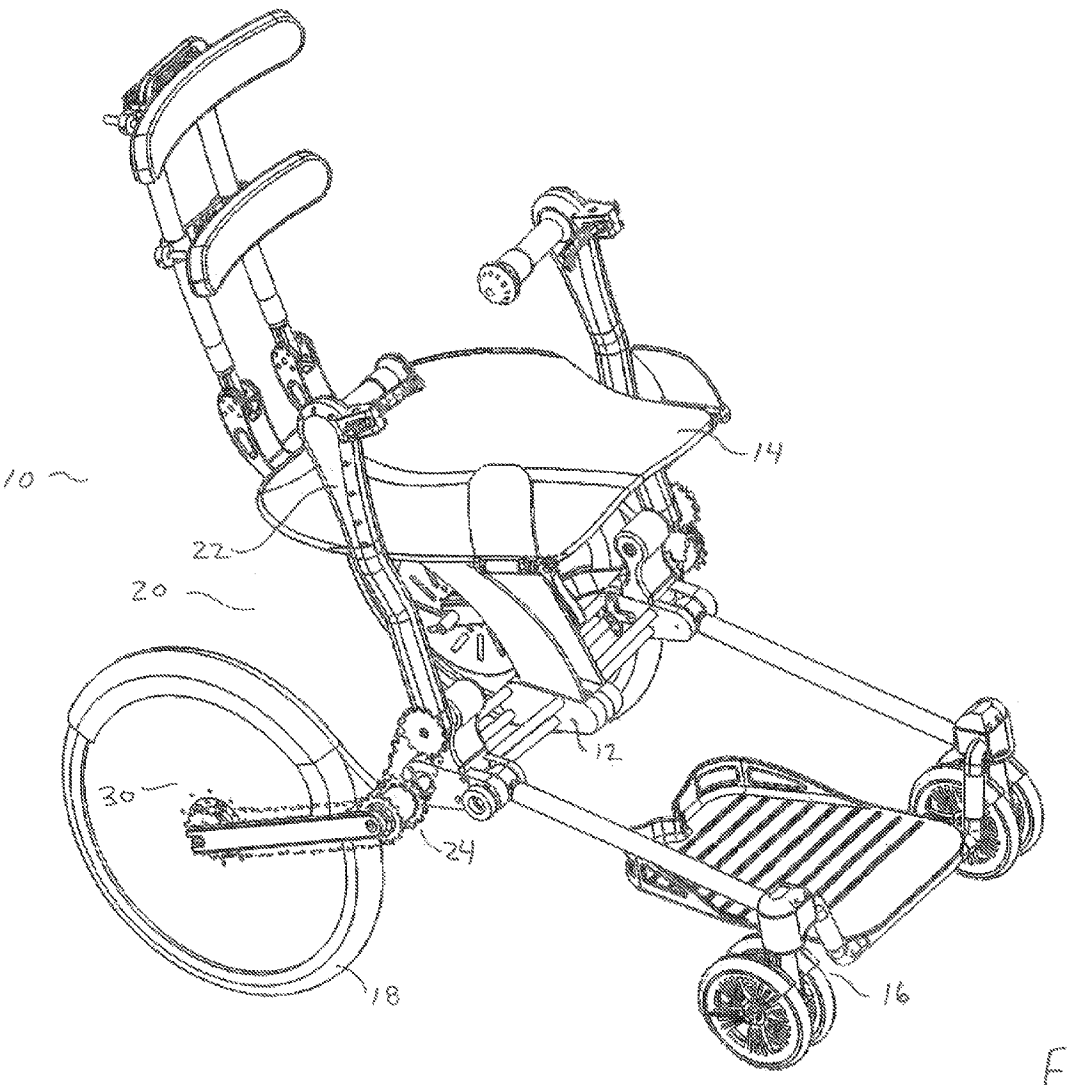
FIG. 1 is a top perspective view of a wheelchair in accordance with one aspect of the invention.
Figure 2:
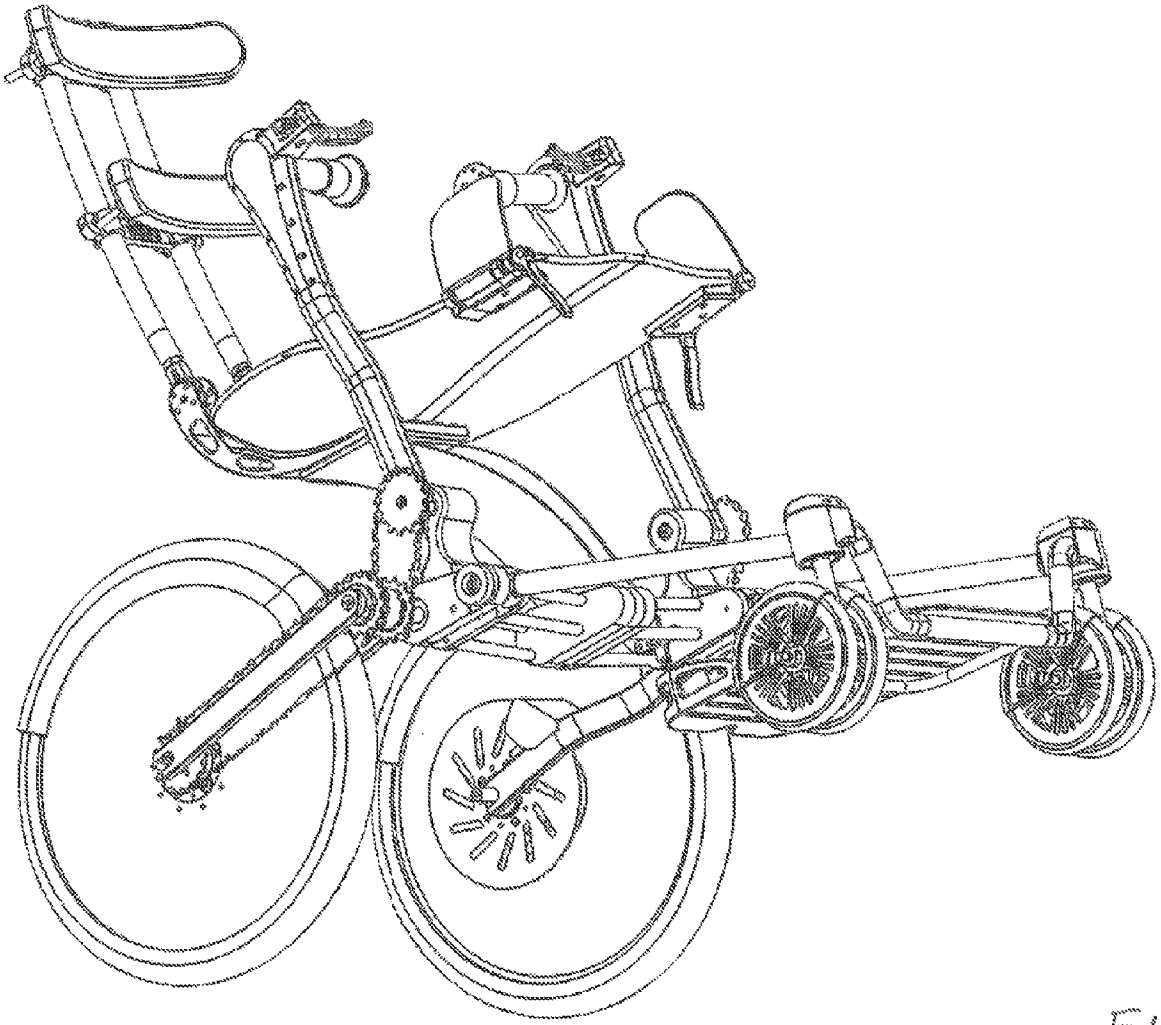
FIG. 2 is a bottom perspective view of a wheelchair in accordance with the invention.
Figure 3:
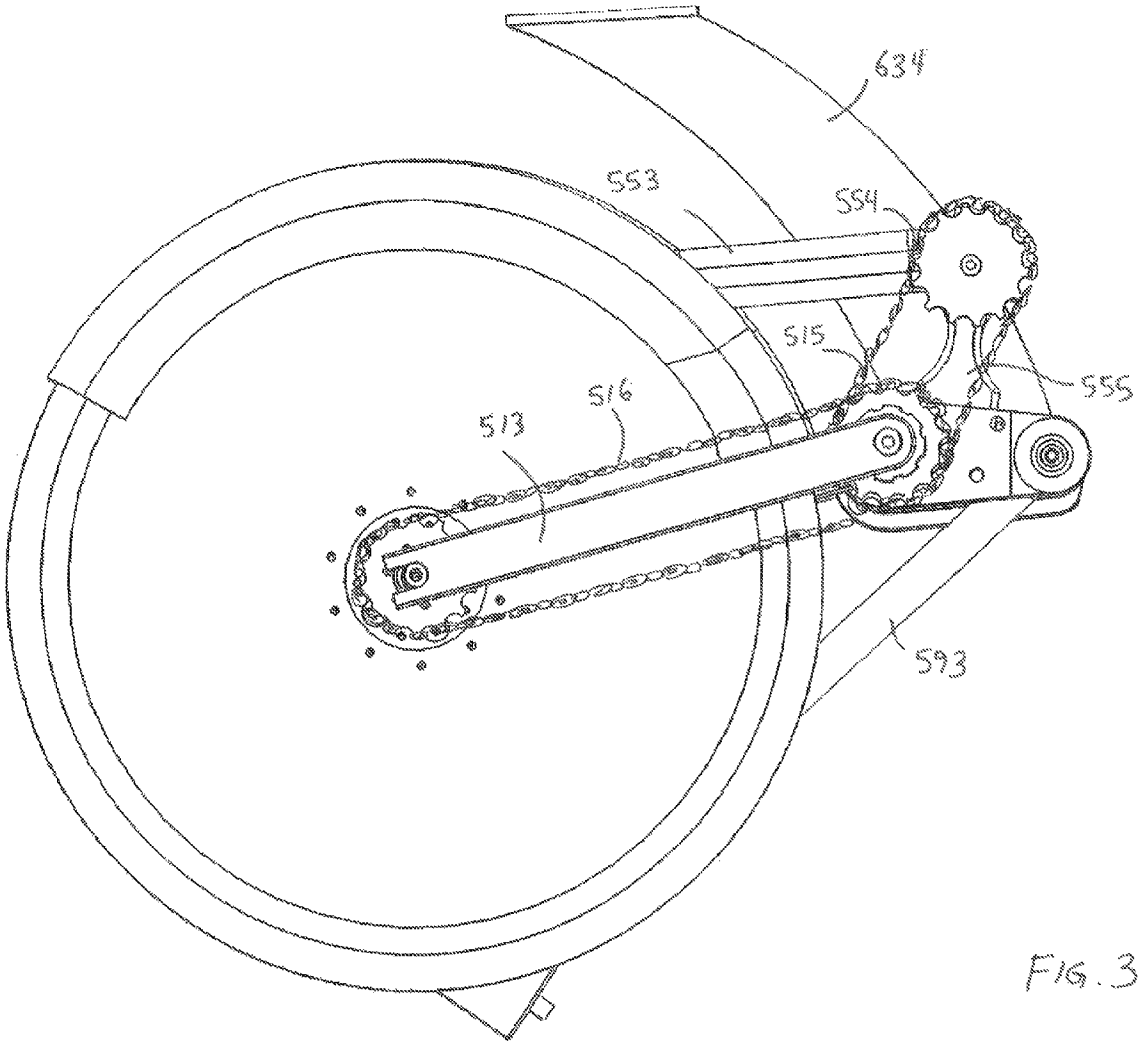
FIG. 3 is a side view detail of the drive and torsion mechanism of the invention.
Figure 4:
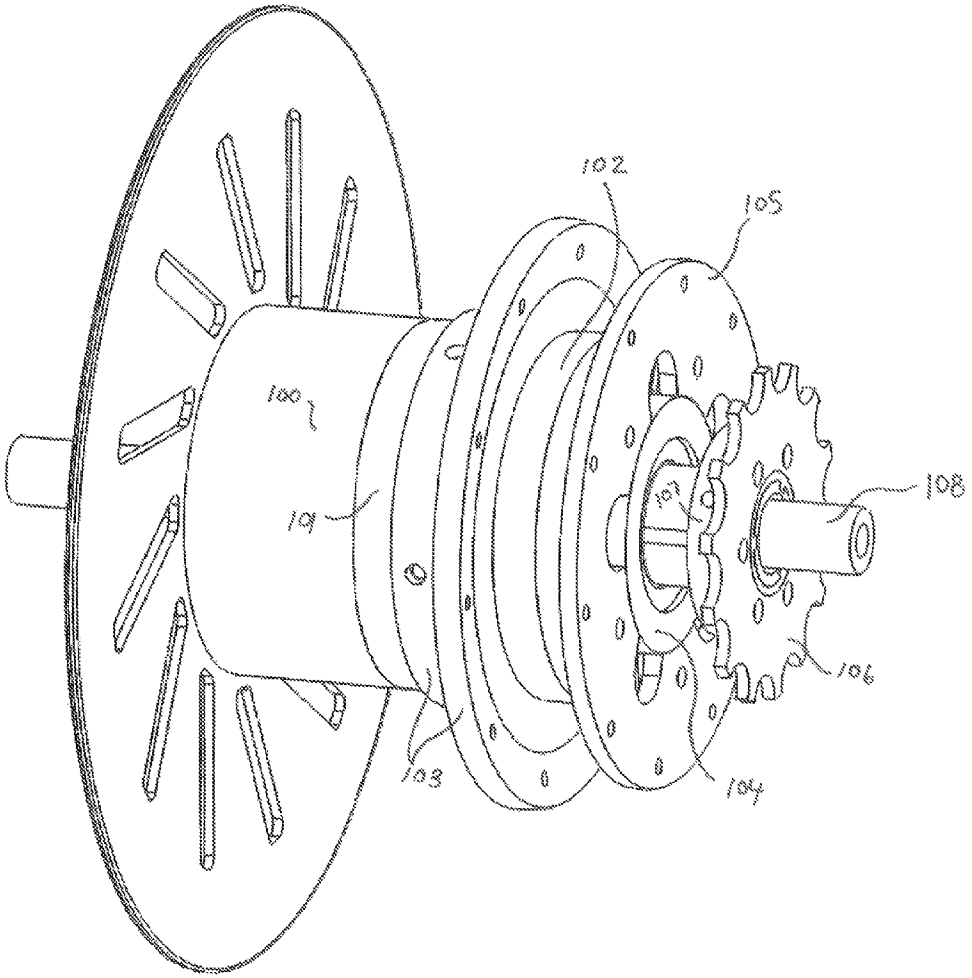
FIG. 4 is a perspective view of the hub and other components, and the brake disk of a wheelchair of the invention.
Figure 5:
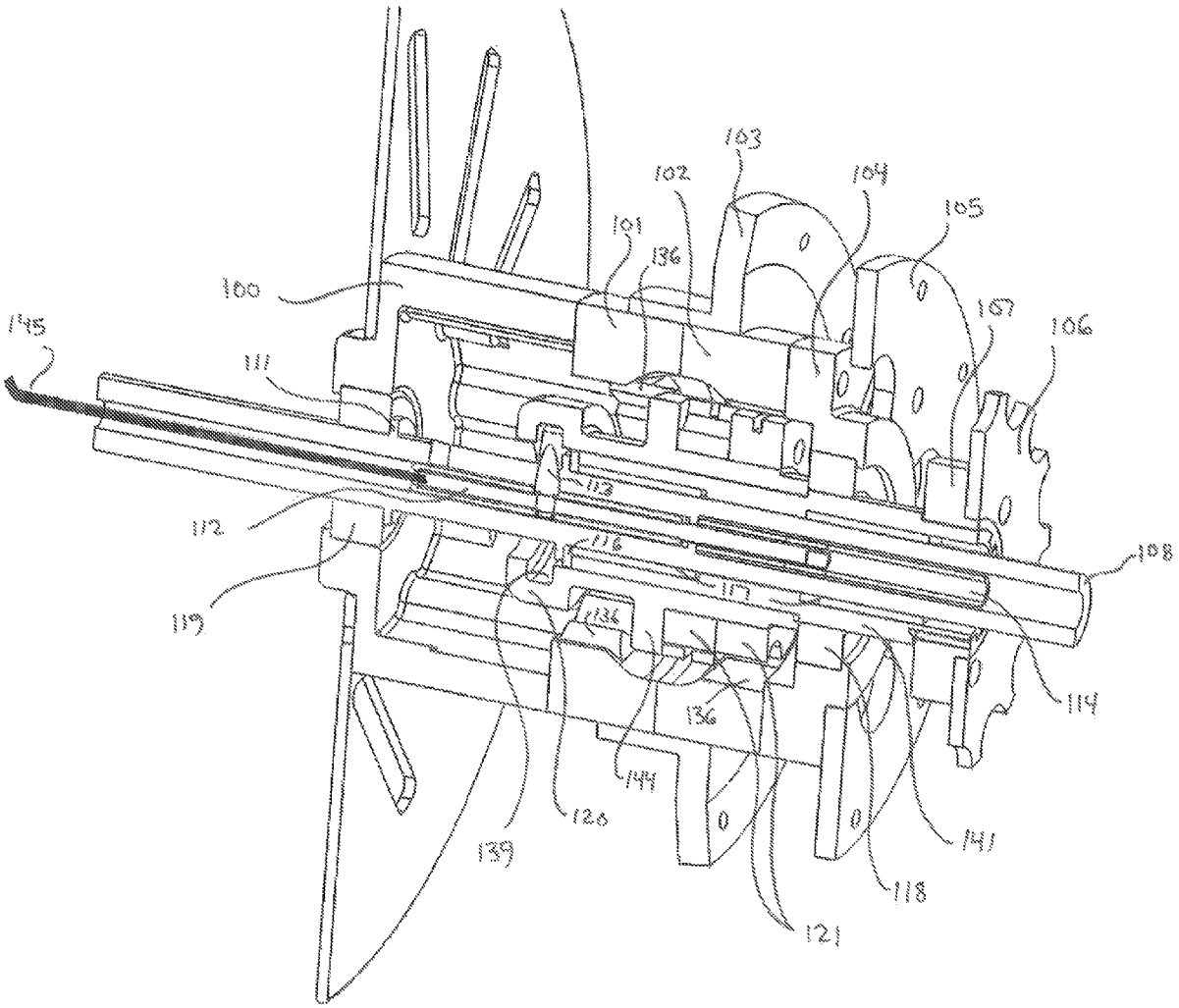
FIG. 5 is a perspective cross-sections through a gear hub in accordance with one aspect of the invention.
Figure 6:
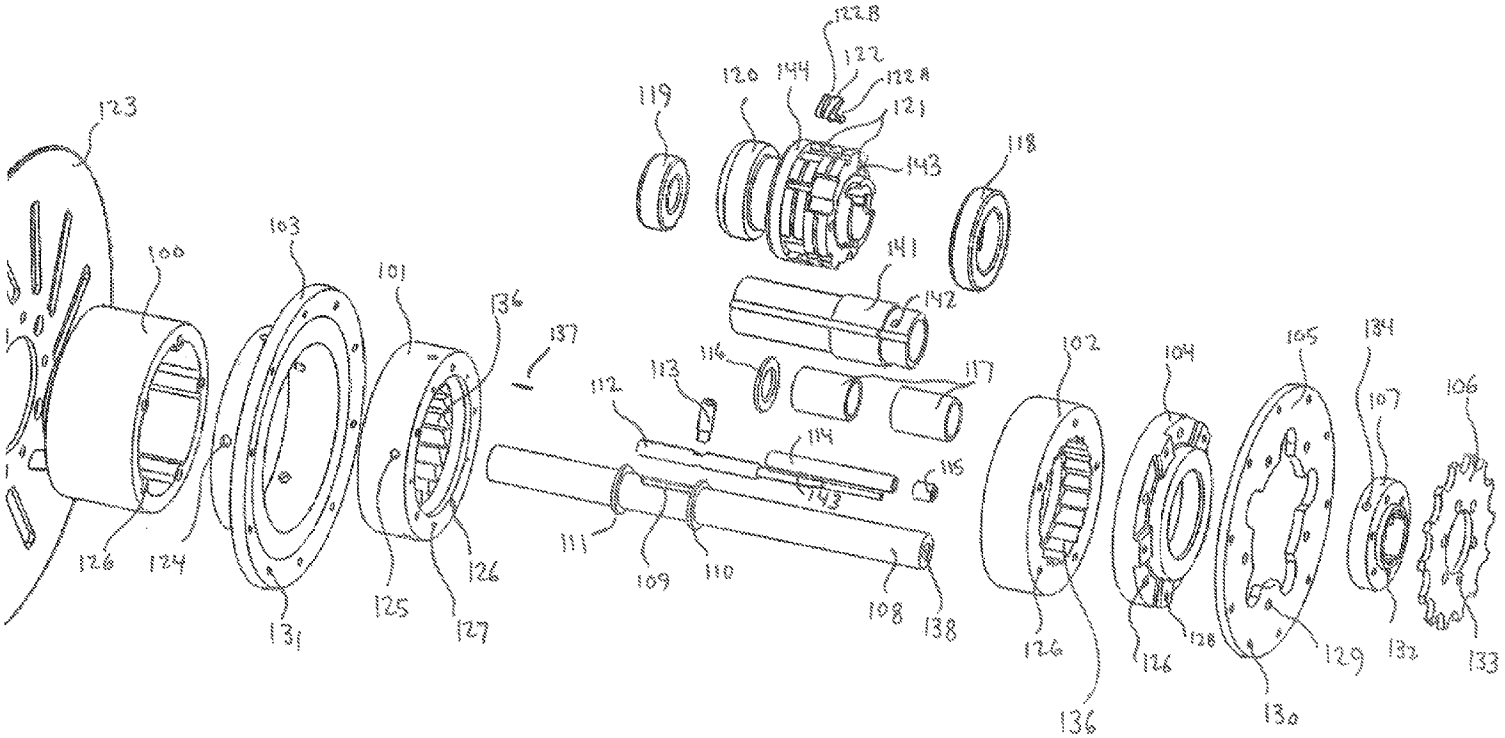
FIG. 6 is an exploded view showing various components and fittings of the gear and hub of the invention.
Figure 7:
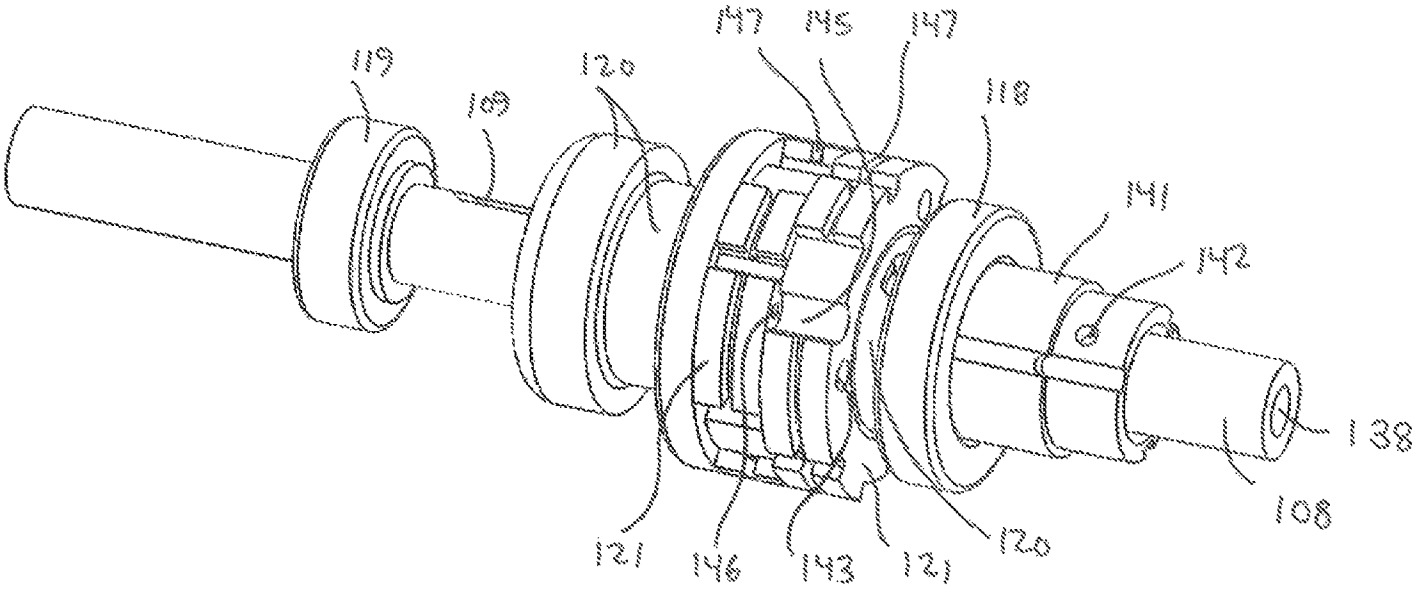
FIG. 7 is a perspective view of a gear and hub in accordance with the invention.
Figure 8:
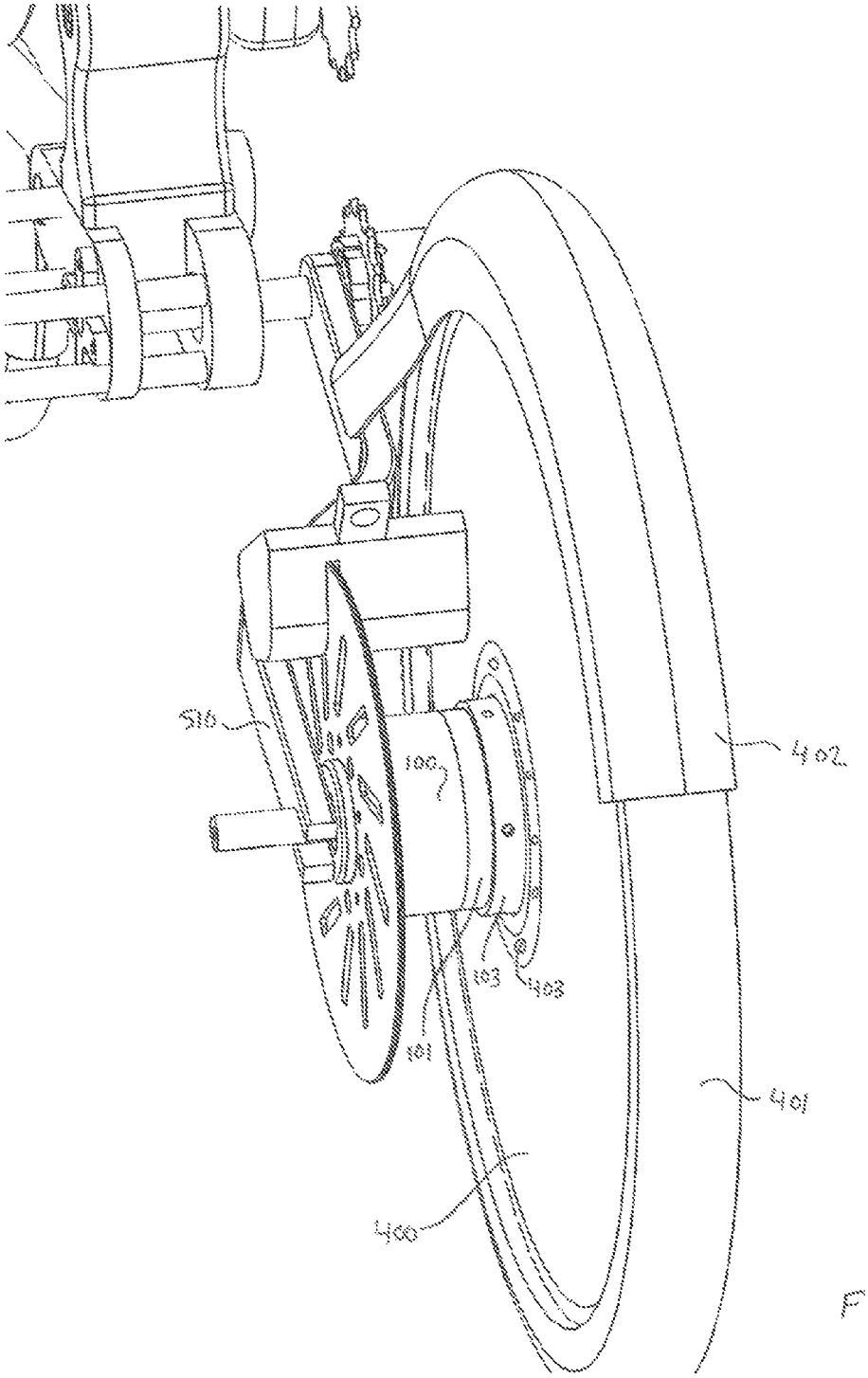
FIG. 8 is a perspective view showing a rear wheel, hub, and other components, as well as a part of the frame.
Figure 9:
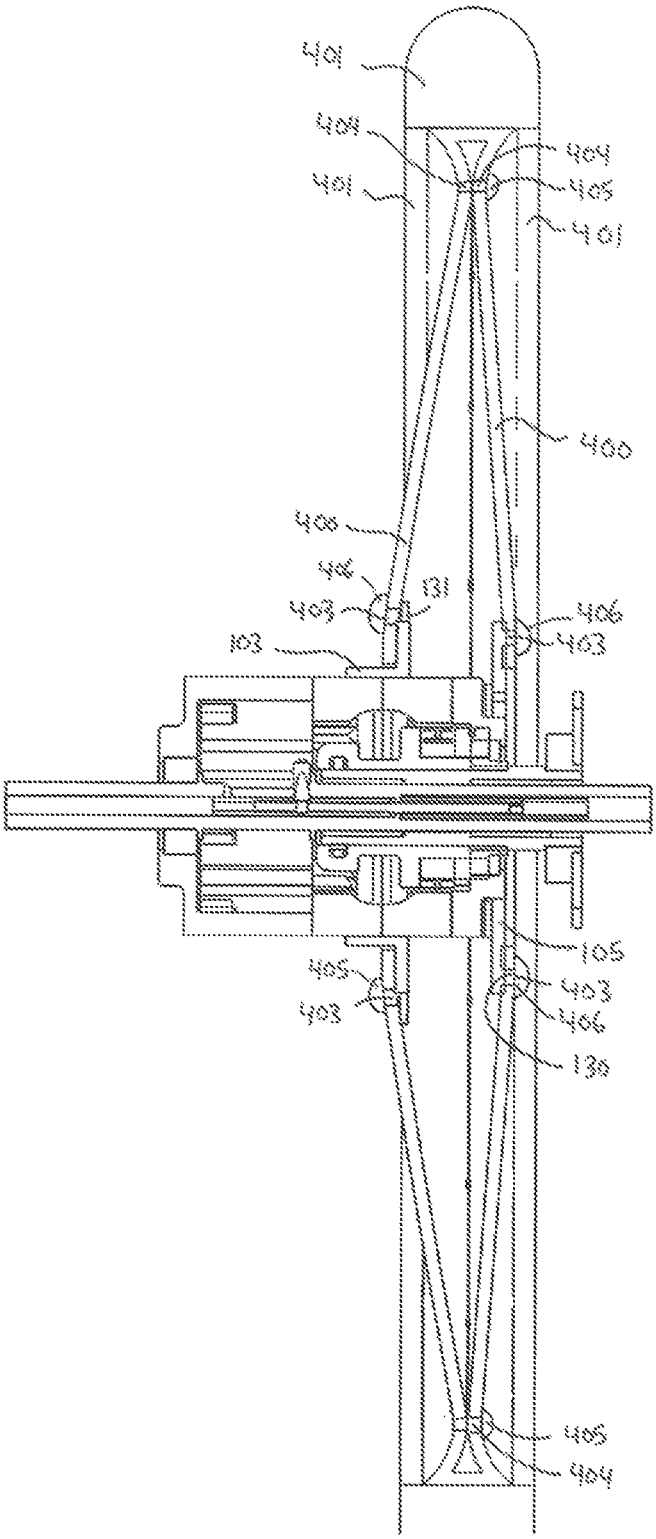
FIG. 9 is a cross-section through the rear wheel and hub and showing the gear mechanism.
Figure 10:
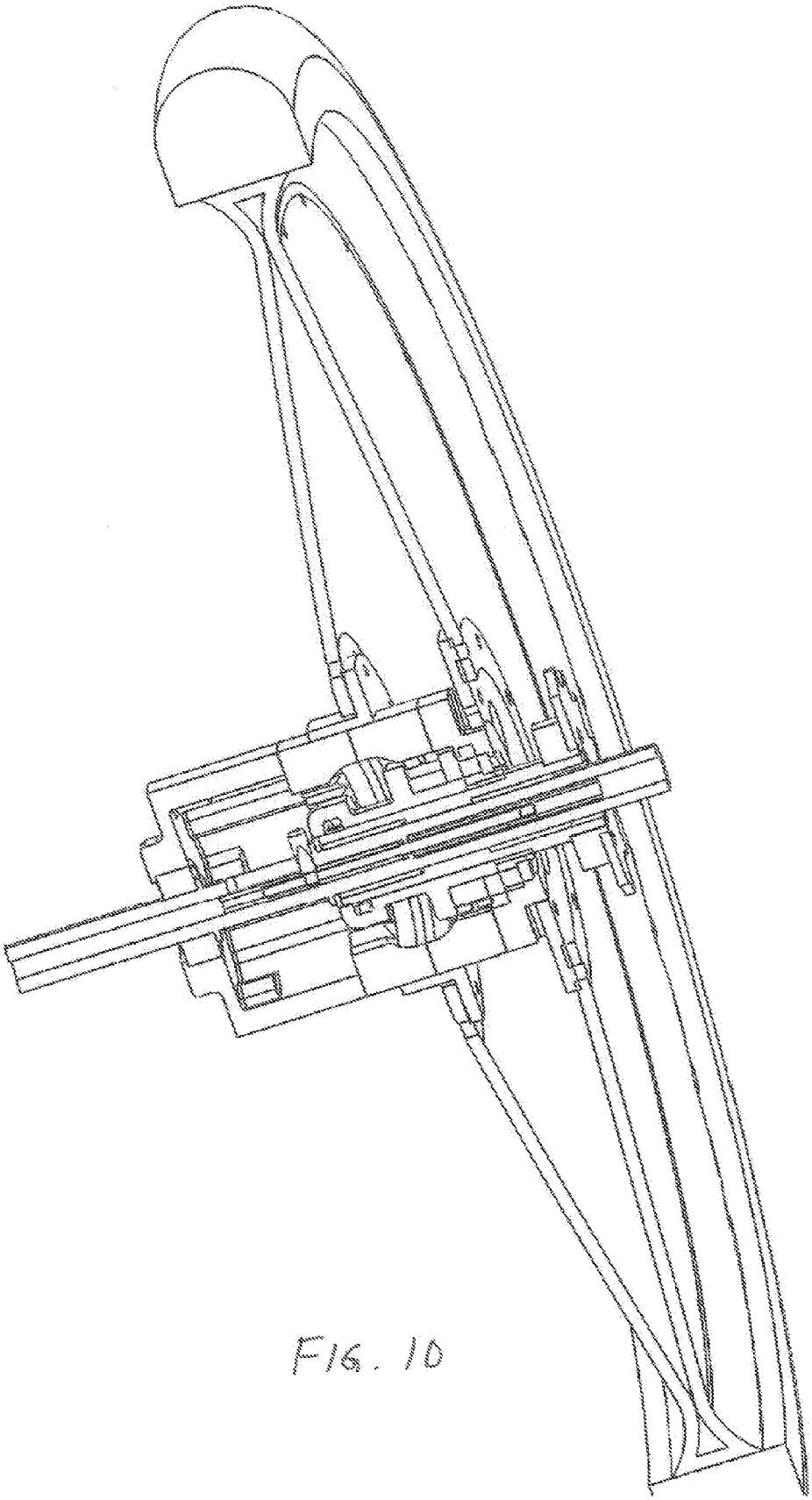
FIG. 10 is a further cross-sectional perspective view of the rear wheel and hub of the type shown in FIG. 9 of the drawings.
Figure 11:
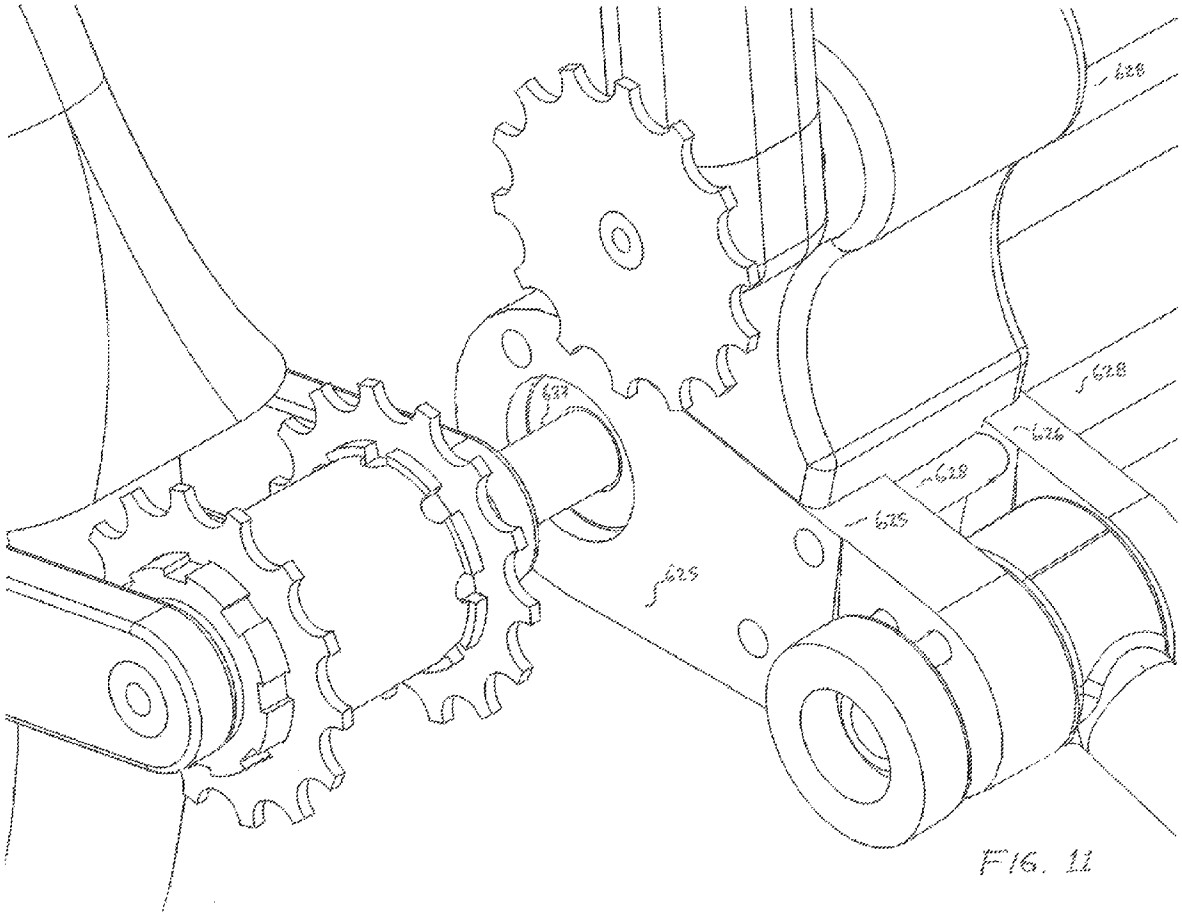
FIG. 11 shows a detail of the frame, arm lever, drive train and torsion bar of the invention.
Figure 12:
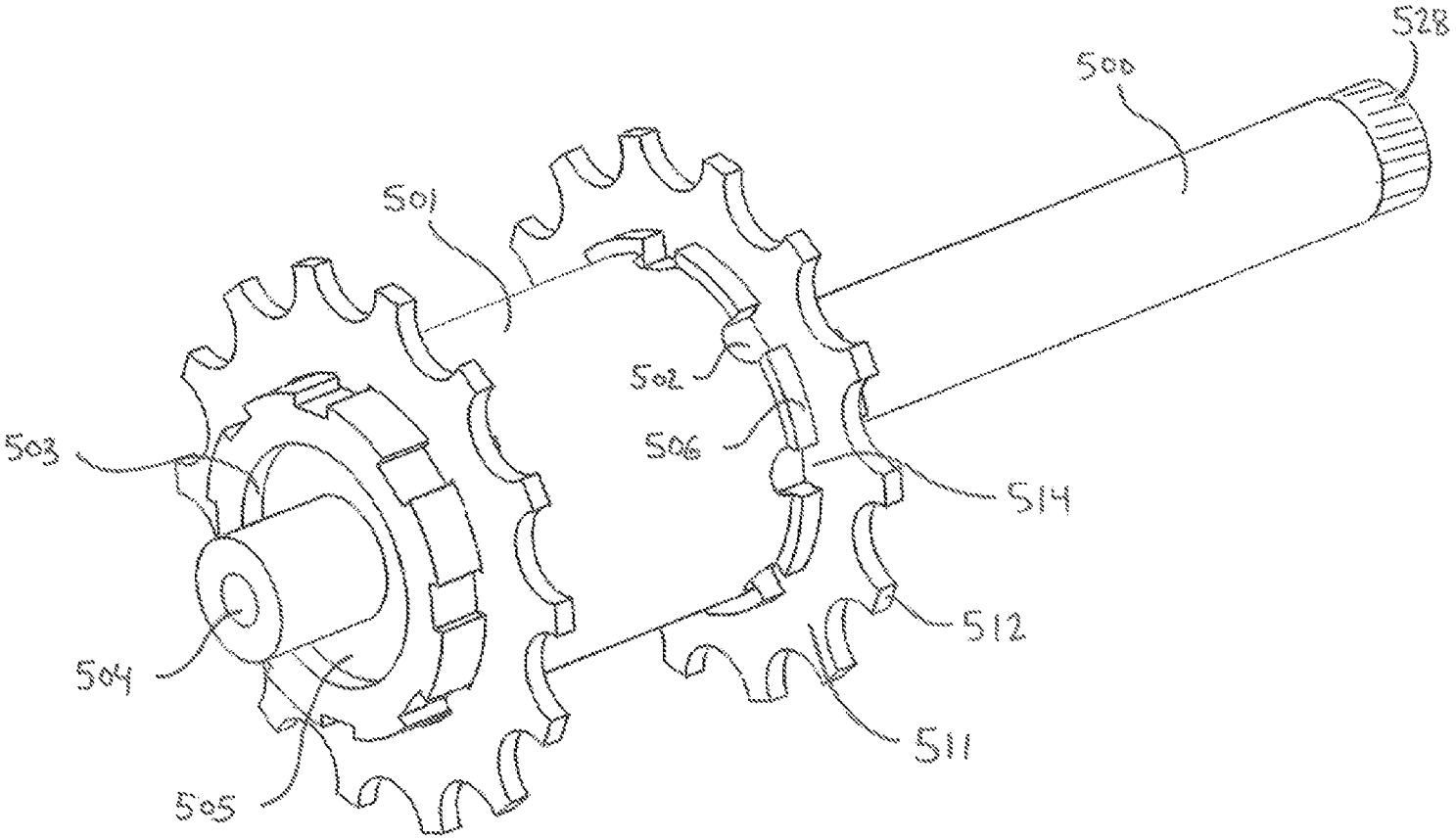
FIG. 12 is a perspective view of a shaft collar and torsion bar which may be used in accordance with the invention.
Figure 13:
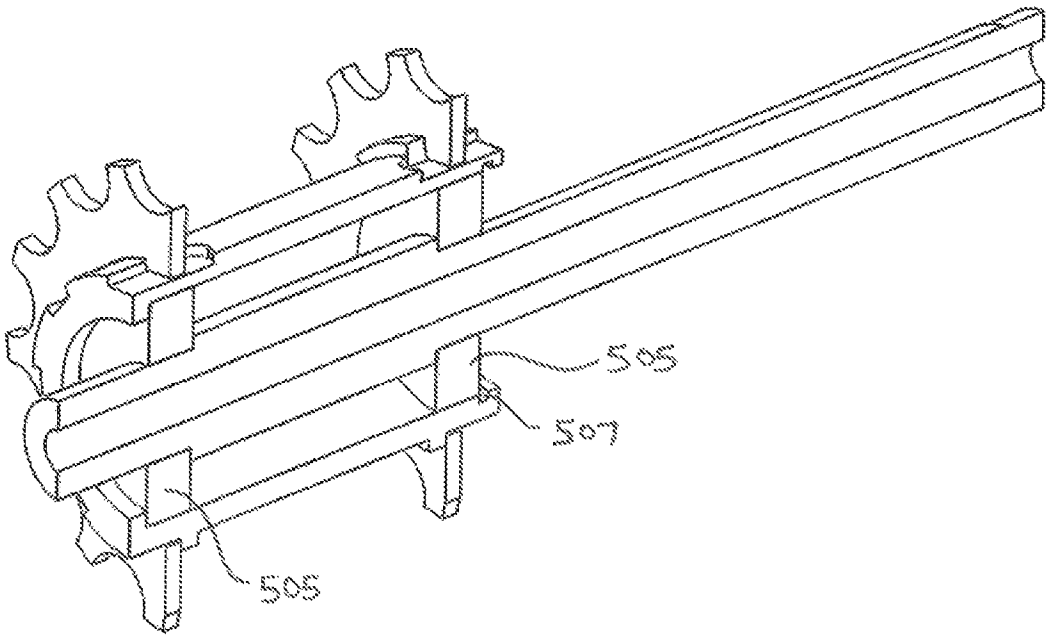
FIG. 13 is a cross-section through the shaft collar as illustrated in FIG. 12 of the drawings.
Figure 14:
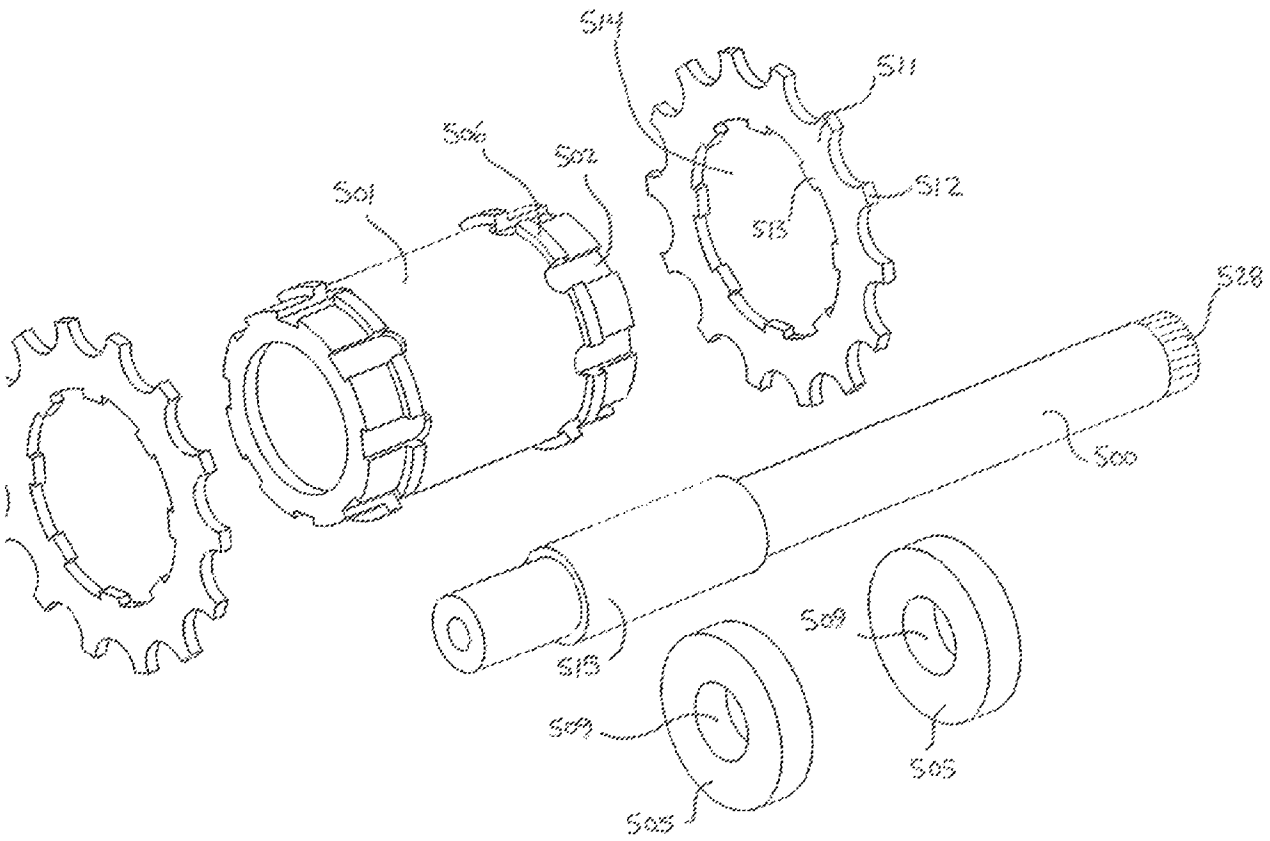
FIG. 14 is an exploded view showing the various parts and components which make up the shaft collar and torsion bar in accordance with the invention.
Figure 15:
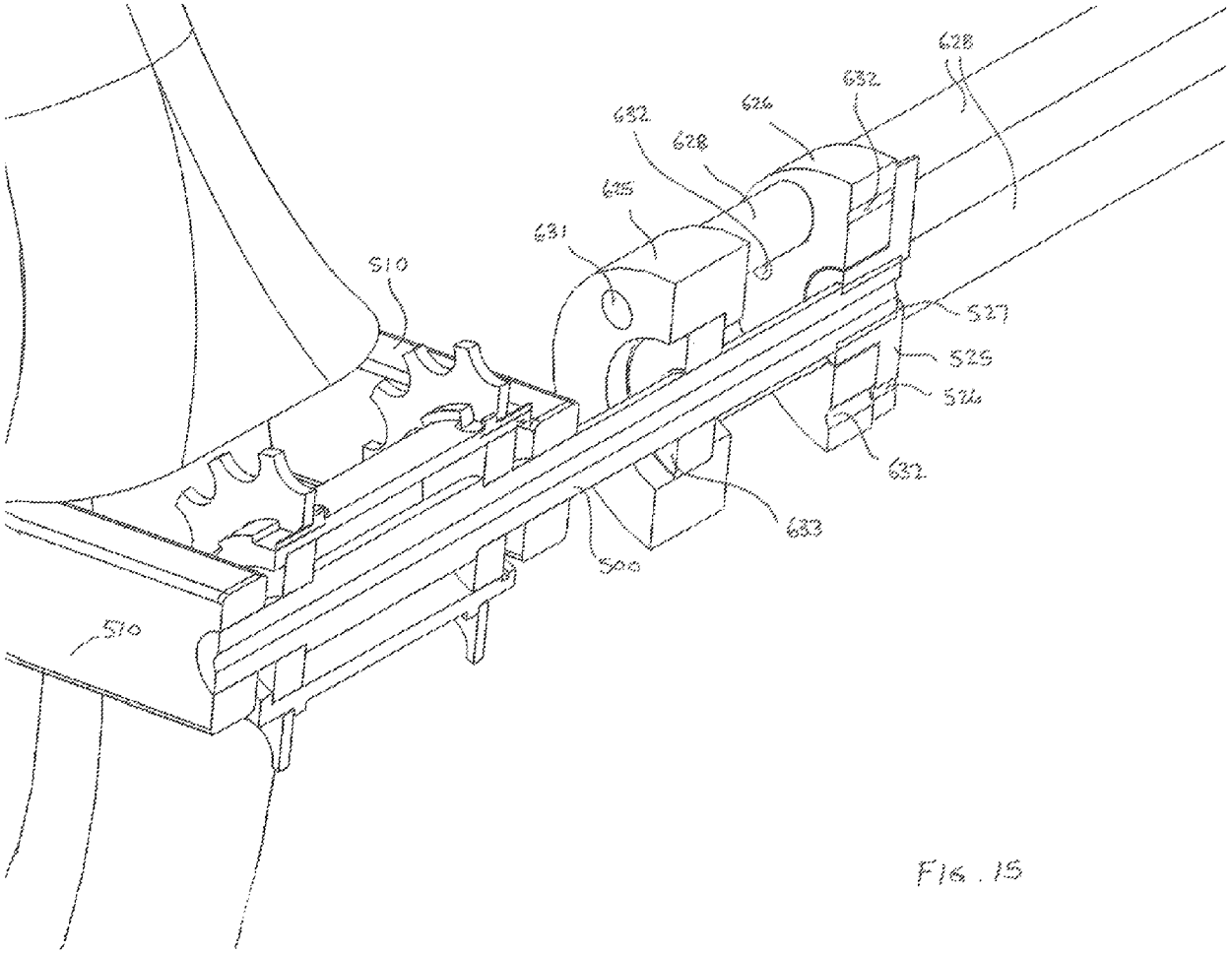
FIG. 15 is a detail view showing the shaft collar in relation to the frame and rear wheel.
Figure 16:
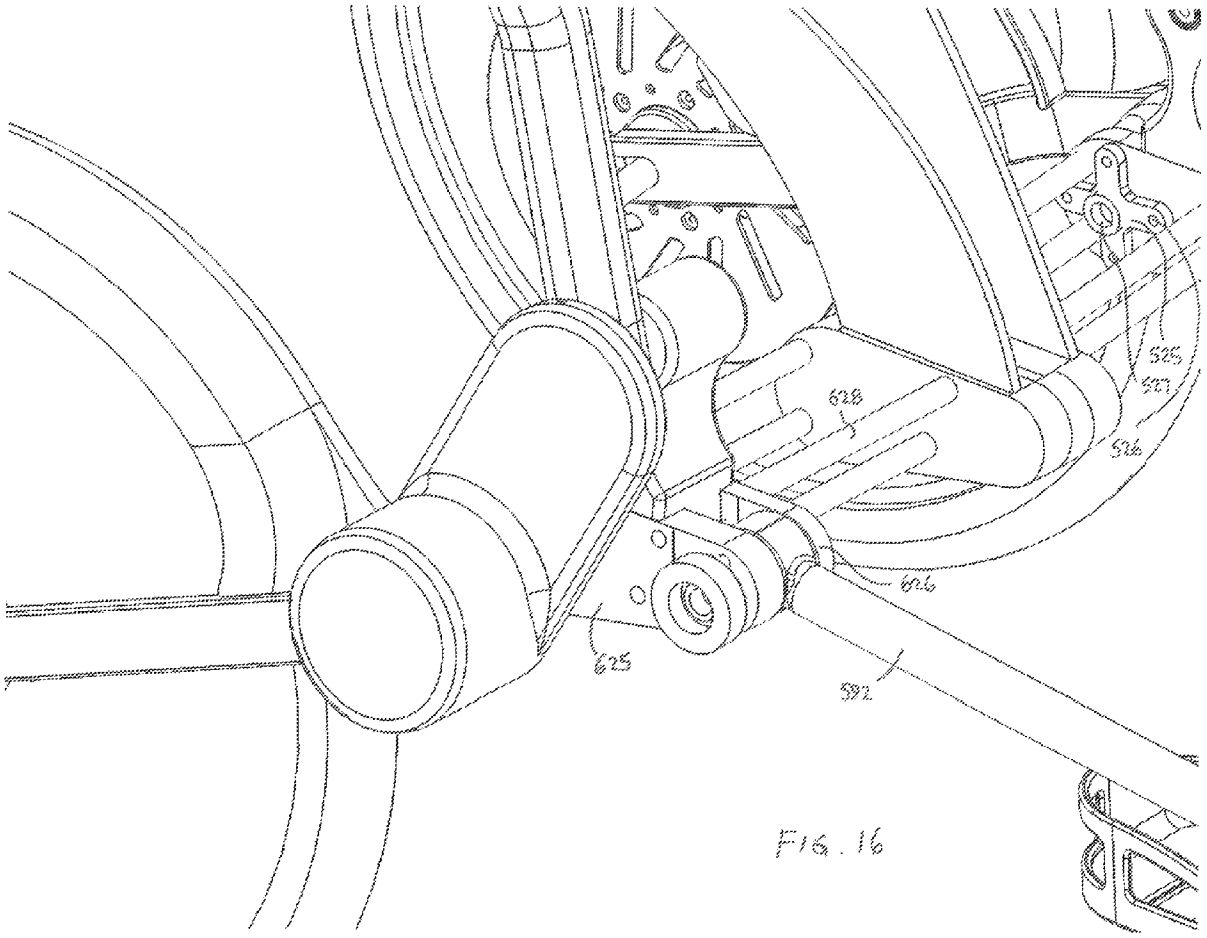
FIG. 16 is a detail of the shaft, torsion bar, swing arm and folding joint area of the invention including a cover.
Figure 17:
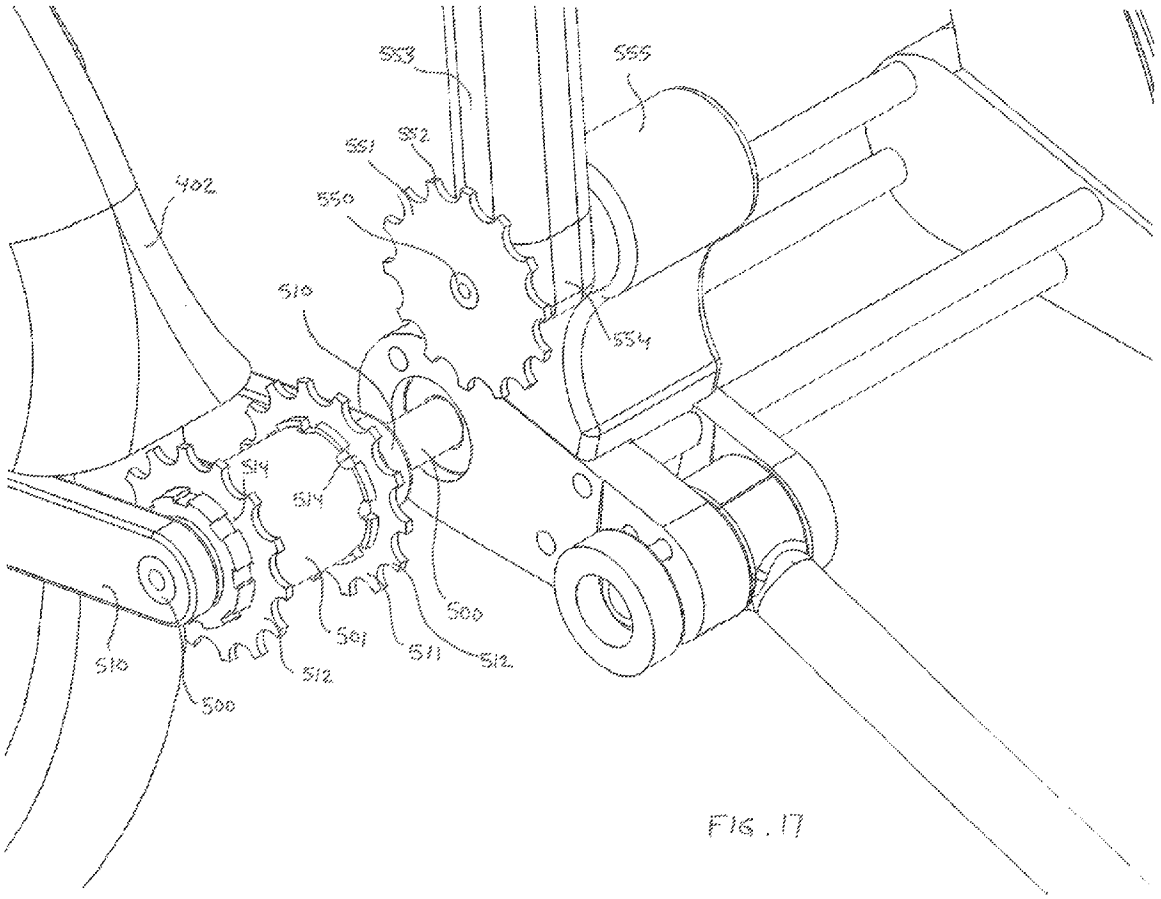
FIG. 17 is a further detail view of the arm lever, frame, drive and other components in accordance with the invention.
Figure 18:
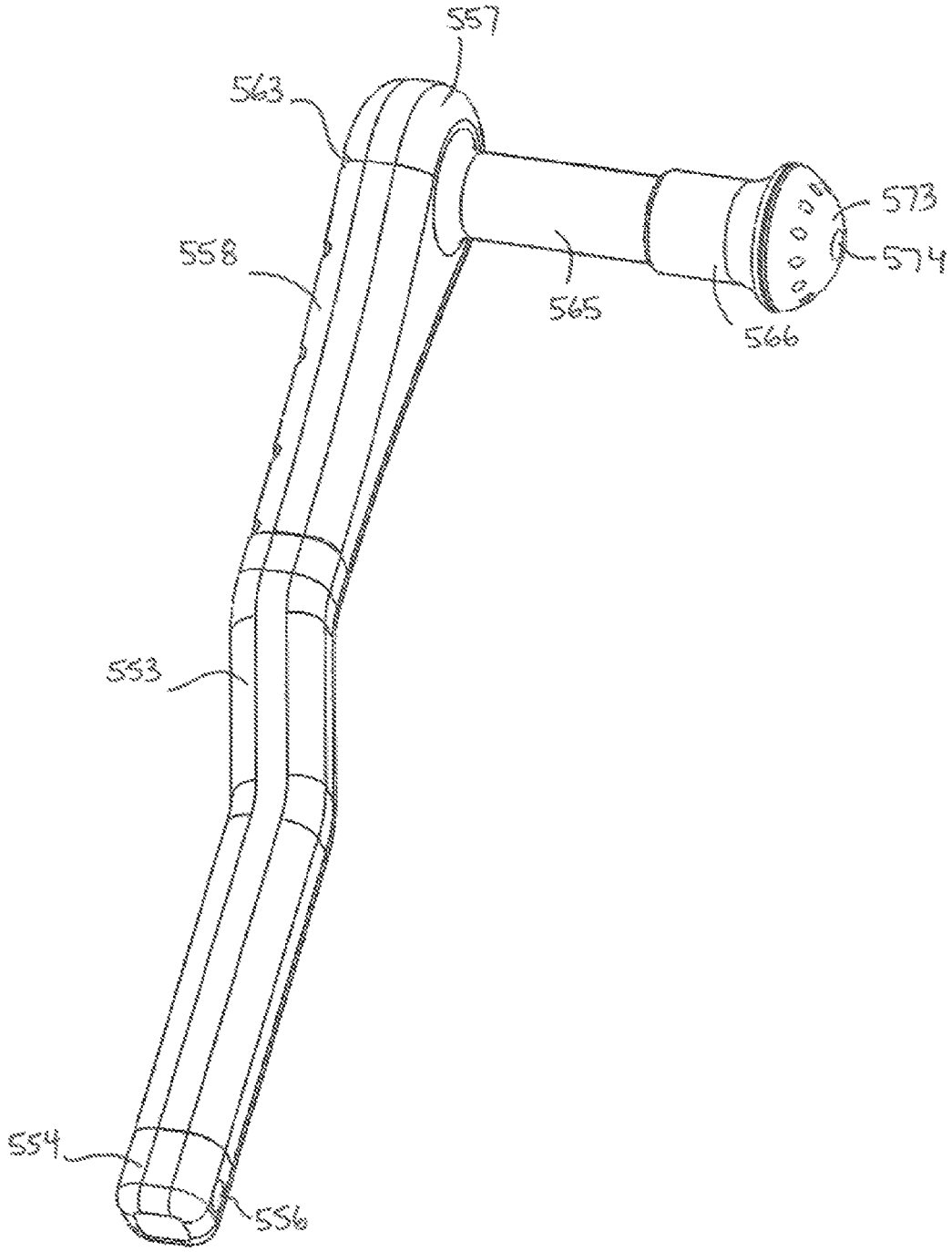
FIG. 18 is a perspective view of an arm lever of a wheelchair in accordance with the invention.
Figure 19:
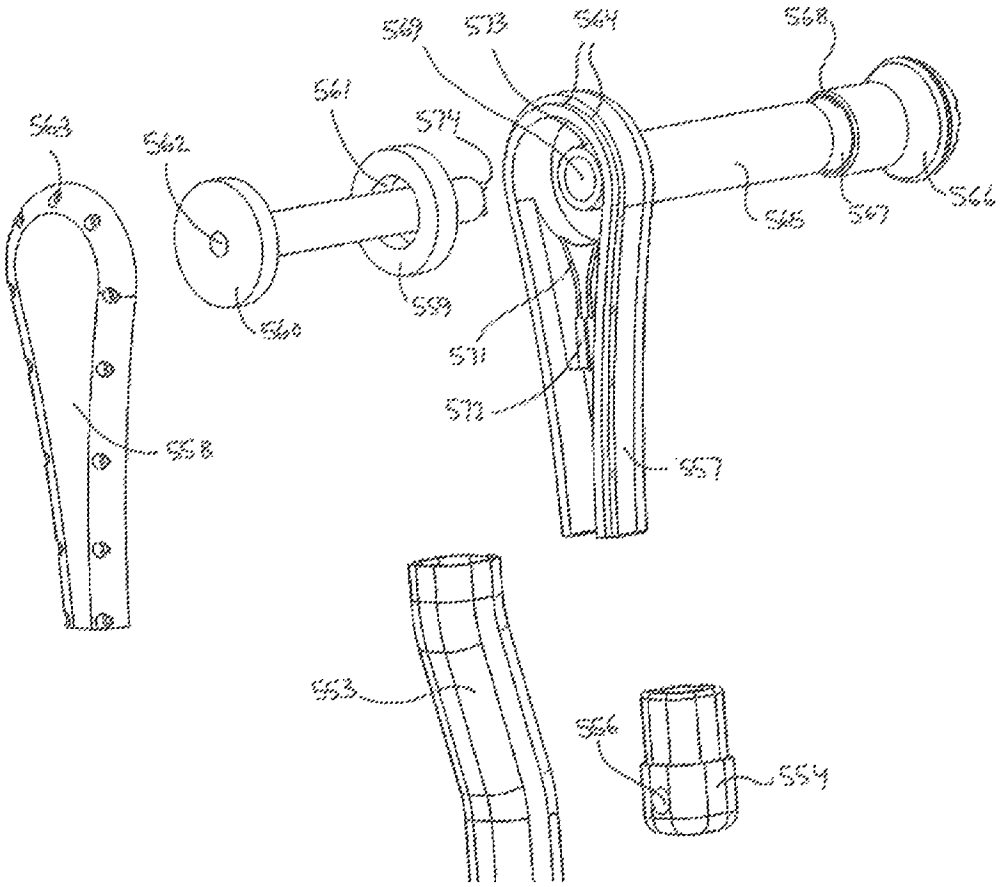
FIG. 19 is an exploded view of the upper portion of the arm lever showing some of the internal components.
Figure 26:
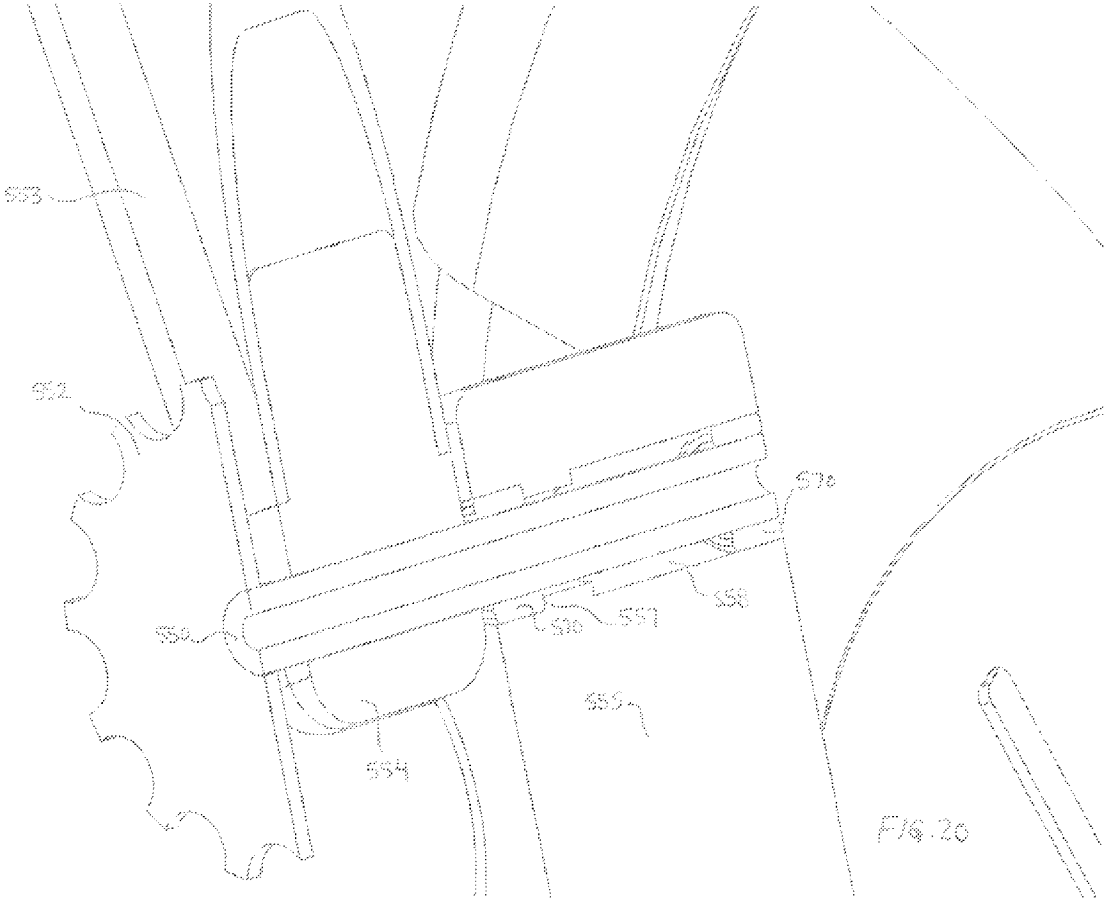
FIG. 26 is a top perspective view of the front wheel assembly and platform of a wheelchair in accordance with one aspect of the invention.
Figure 21:
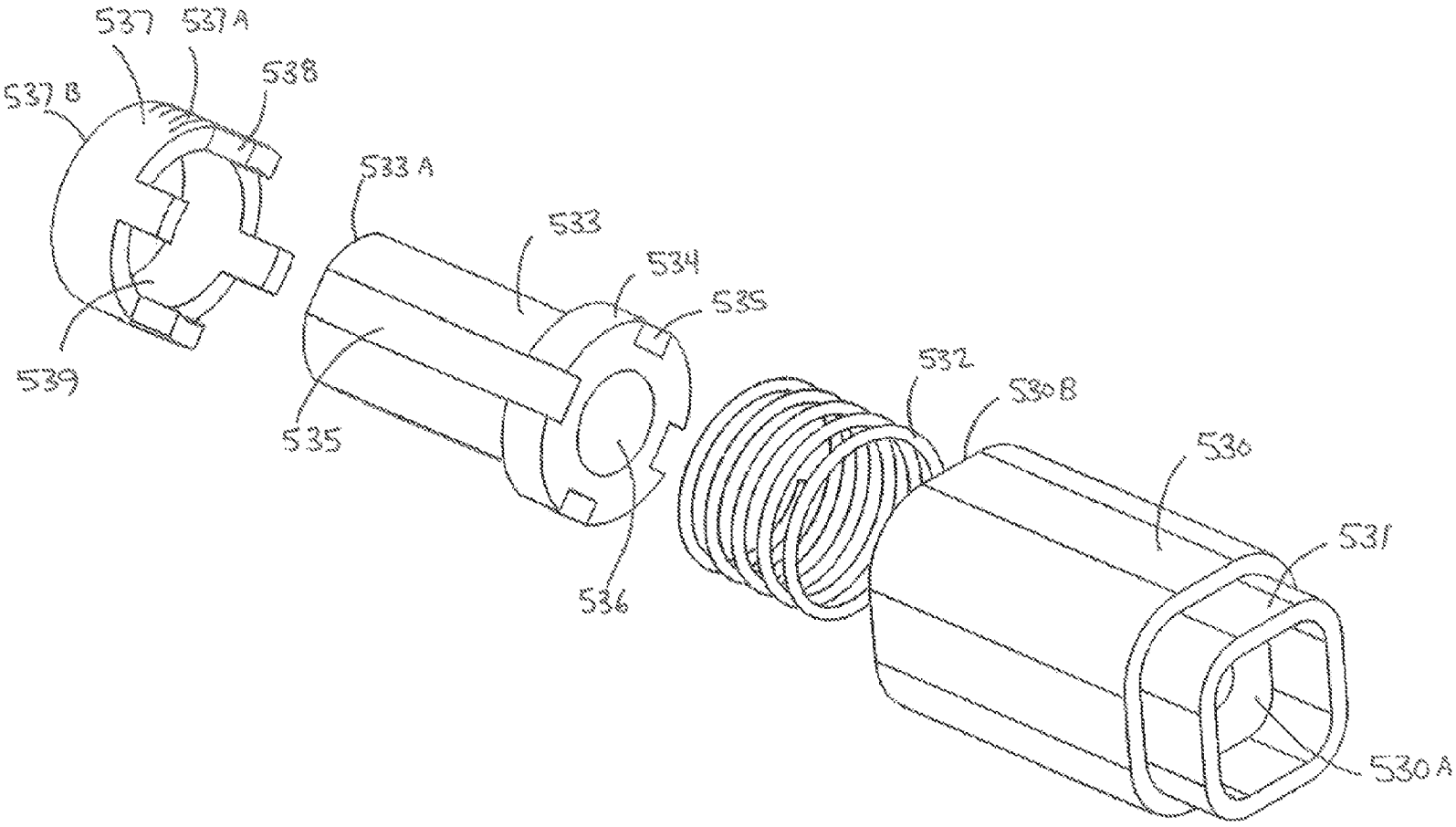
FIG. 21 is an exploded detail view of the arm lever pivot joint to facilitate folding of the handle on the arm lever.
Figure 22:
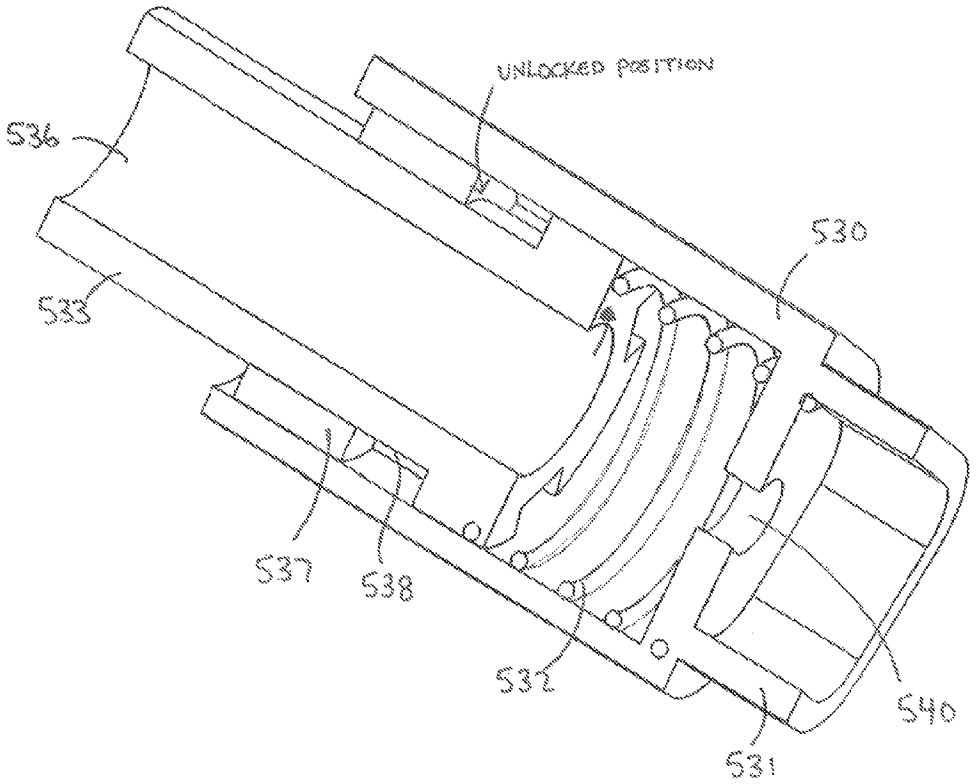
FIG. 22 is a cross-section detail showing the pivot joint Of FIG. 21 of the drawings, in the unlocked position.
Figure 23:
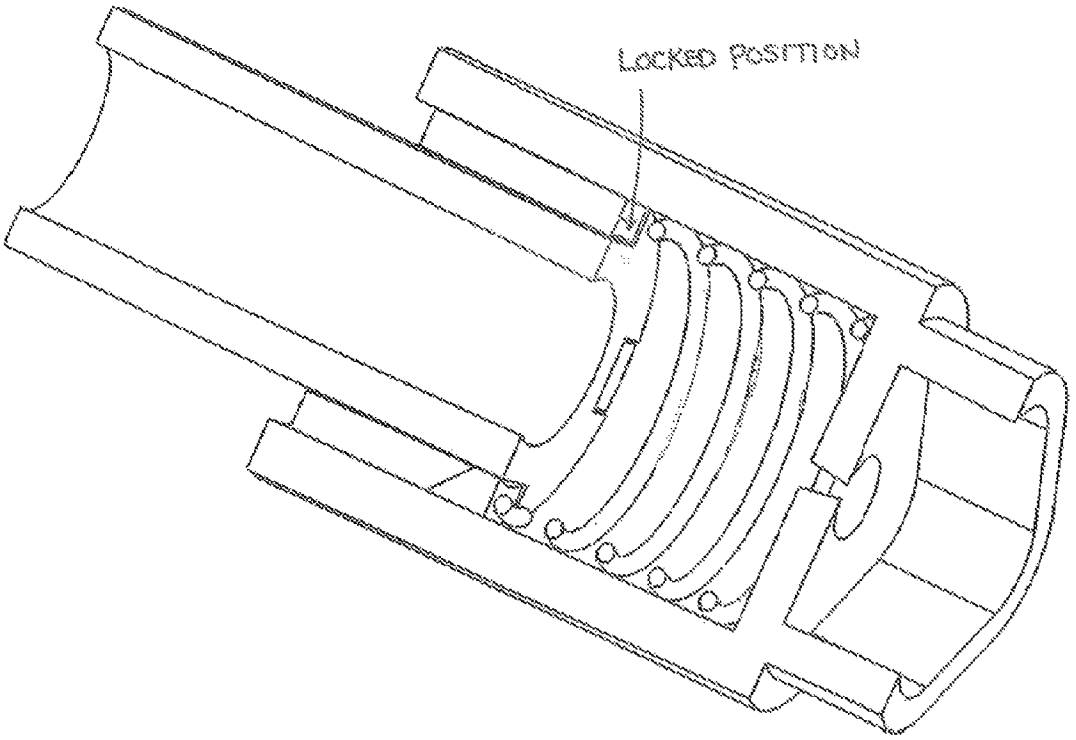
FIG. 23 is a cross-section detail showing the pivot joint of FIG. 21 of the drawings, in the locked position.
Figure 24:
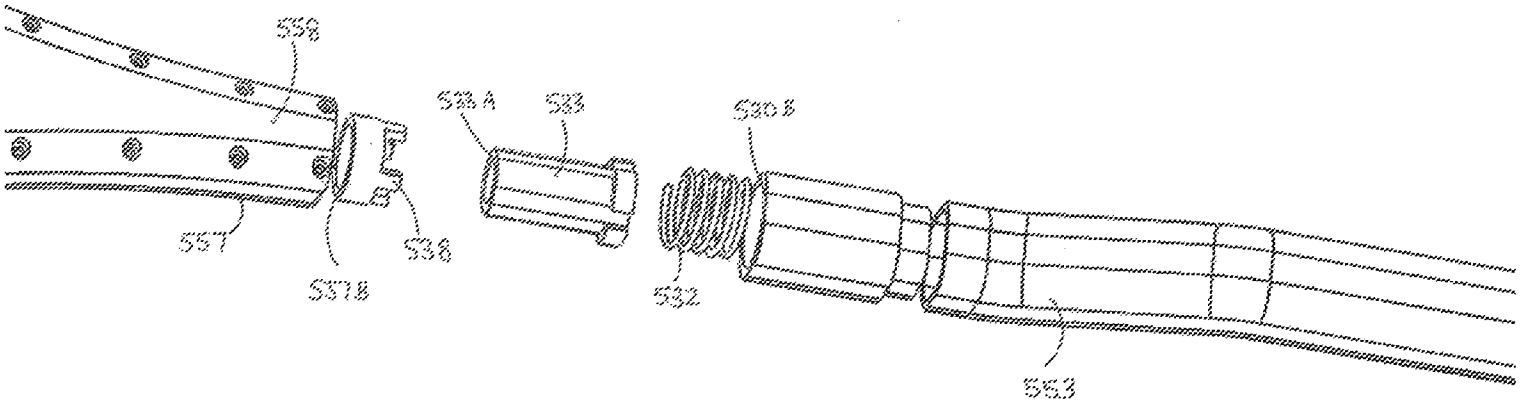
FIG. 24 is an exploded view of a part of the arm lever and the pivot joint.
Figure 25:
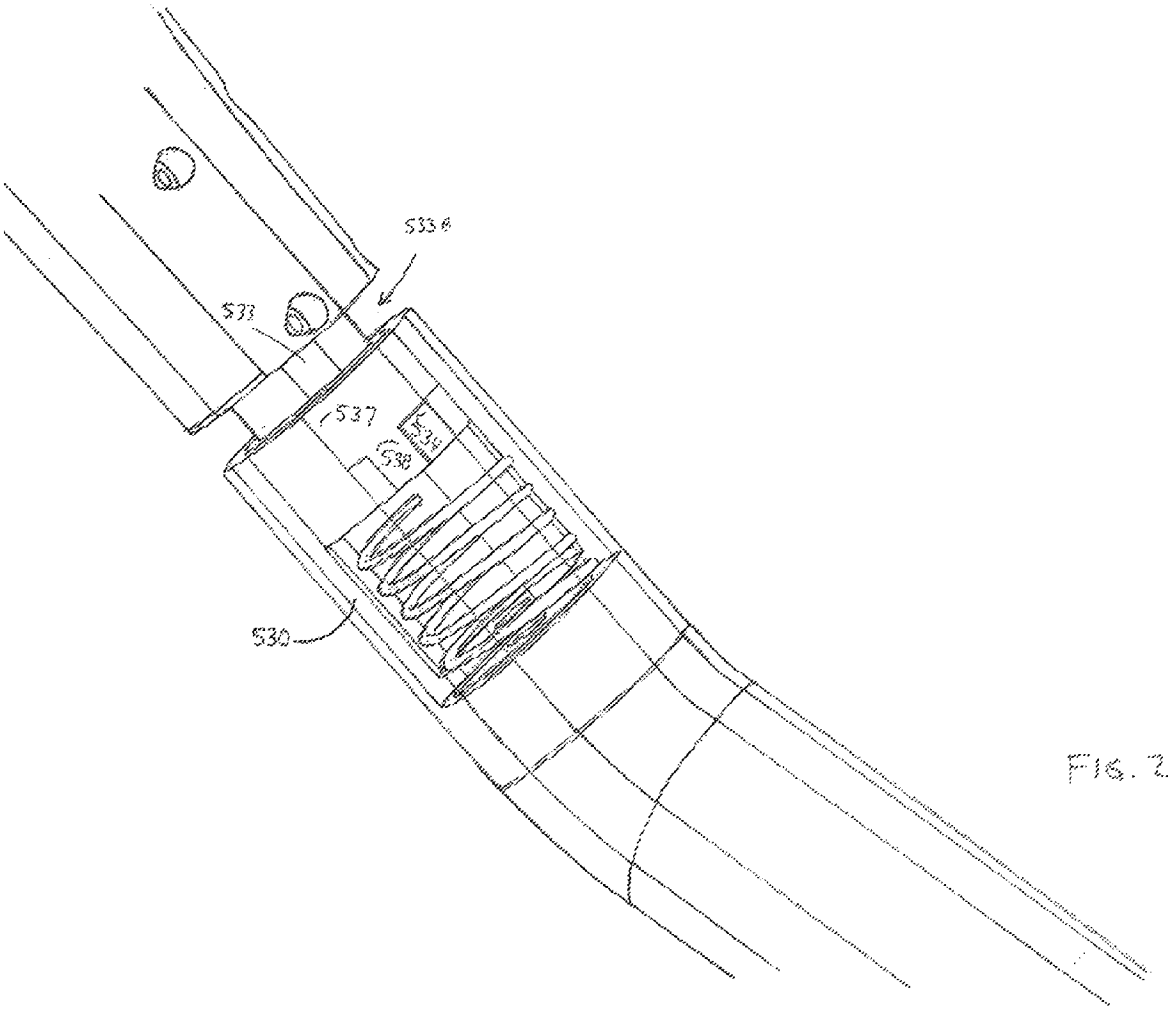
FIG. 25 is a detail of the lever arm at the pivot joint illustrating the space.
Figure 26:
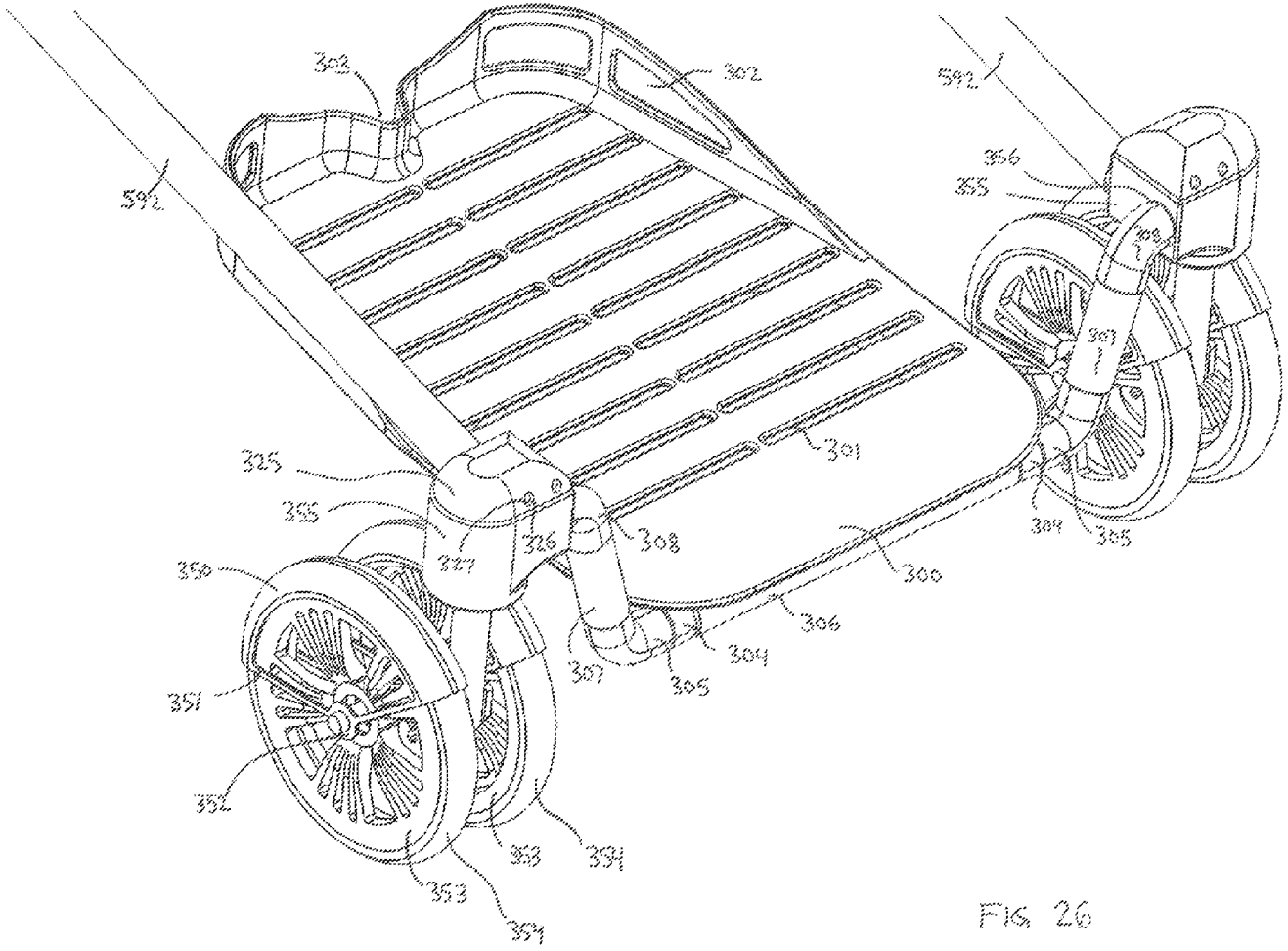
Figure 27:
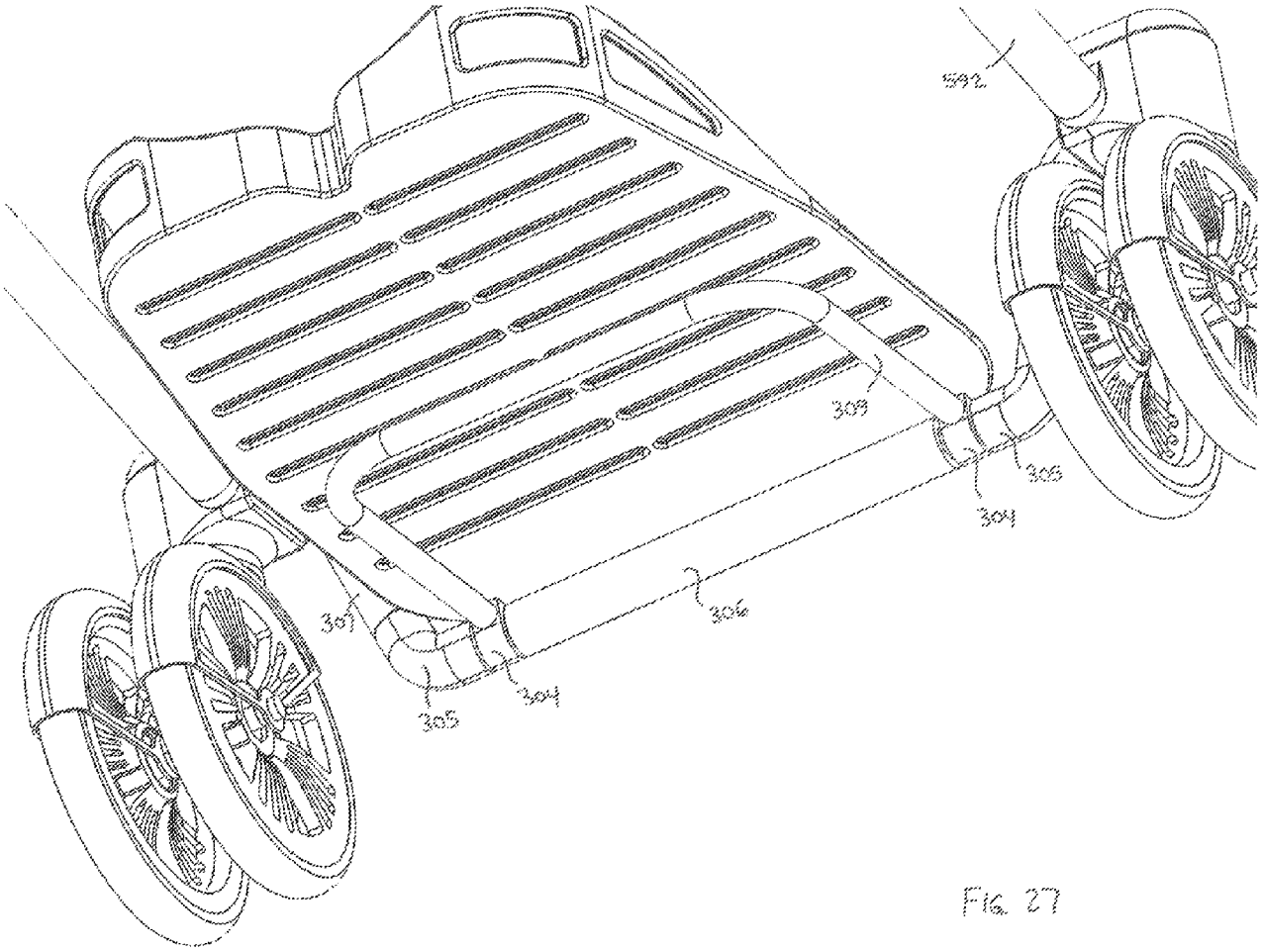
FIG. 27 is a bottom perspective view of the front wheel assembly and platform.
Figure 28:
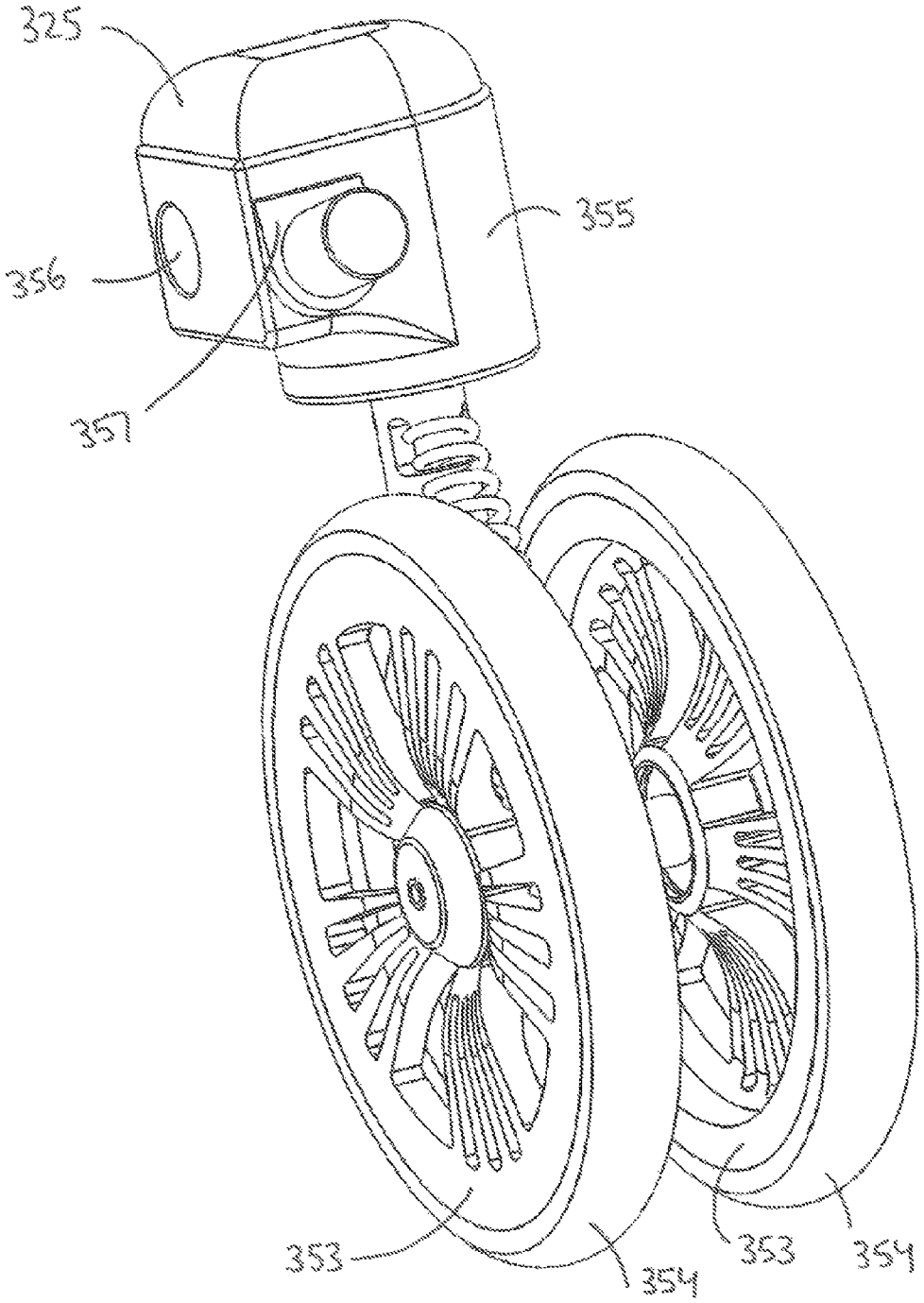
FIG. 28 is a detail view of a pair of front wheels and suspension mechanism.
Figure 29:
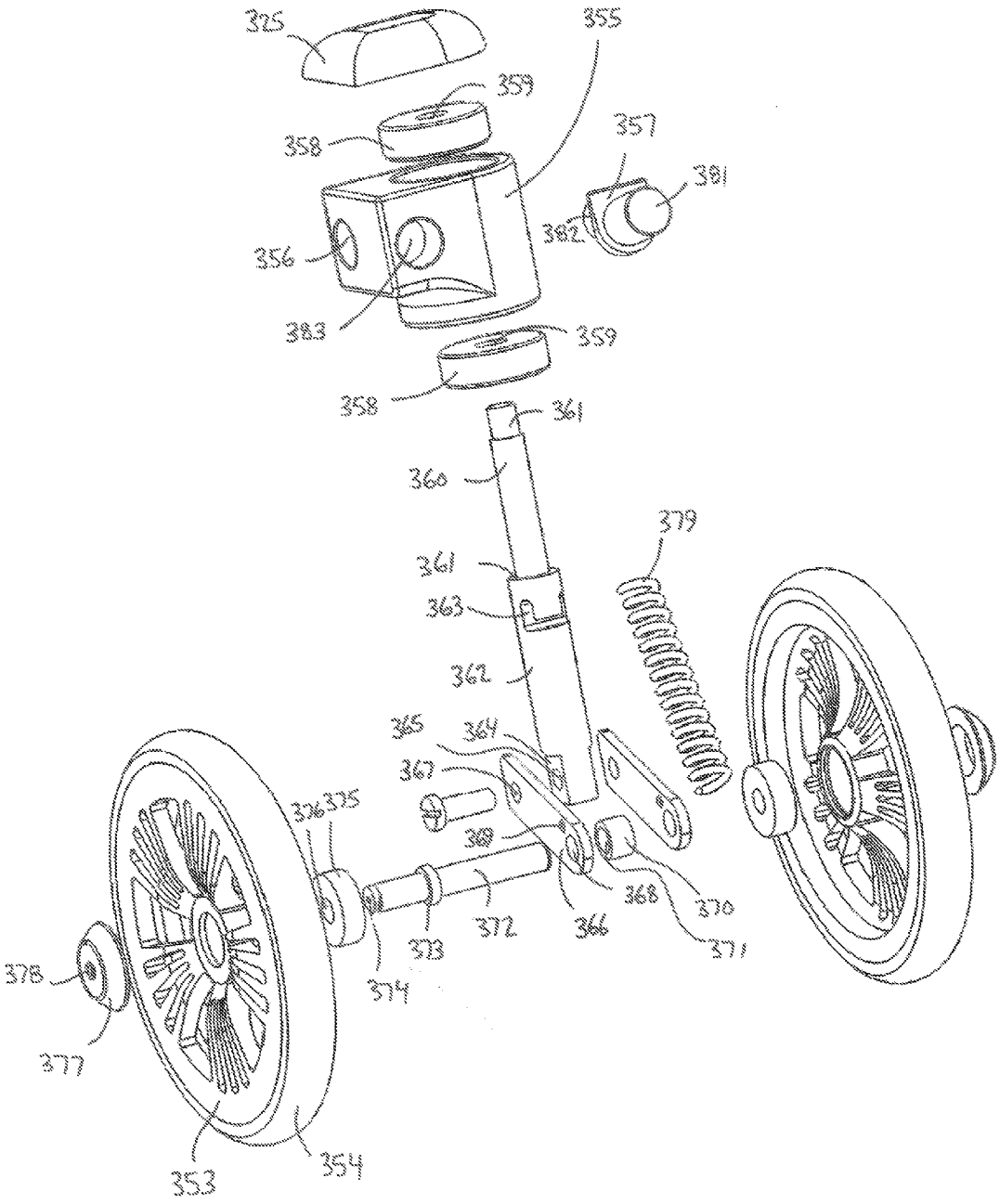
FIG. 29 is an exploded view of a front wheel assembly and suspension mechanism.
Figure 30:
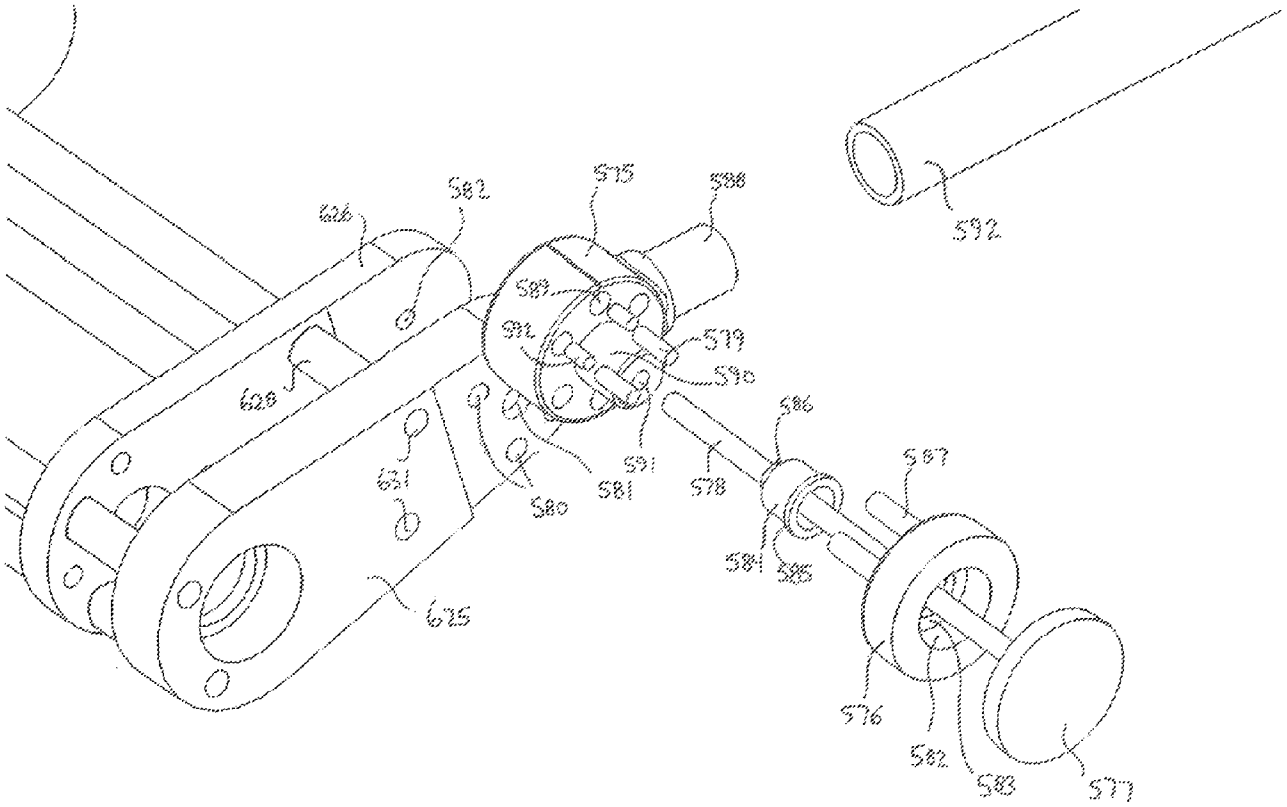
FIG. 30 shows a detail exploded view of the folding joint and part of the frame of a wheelchair in accordance with the invention.
Figure 31:
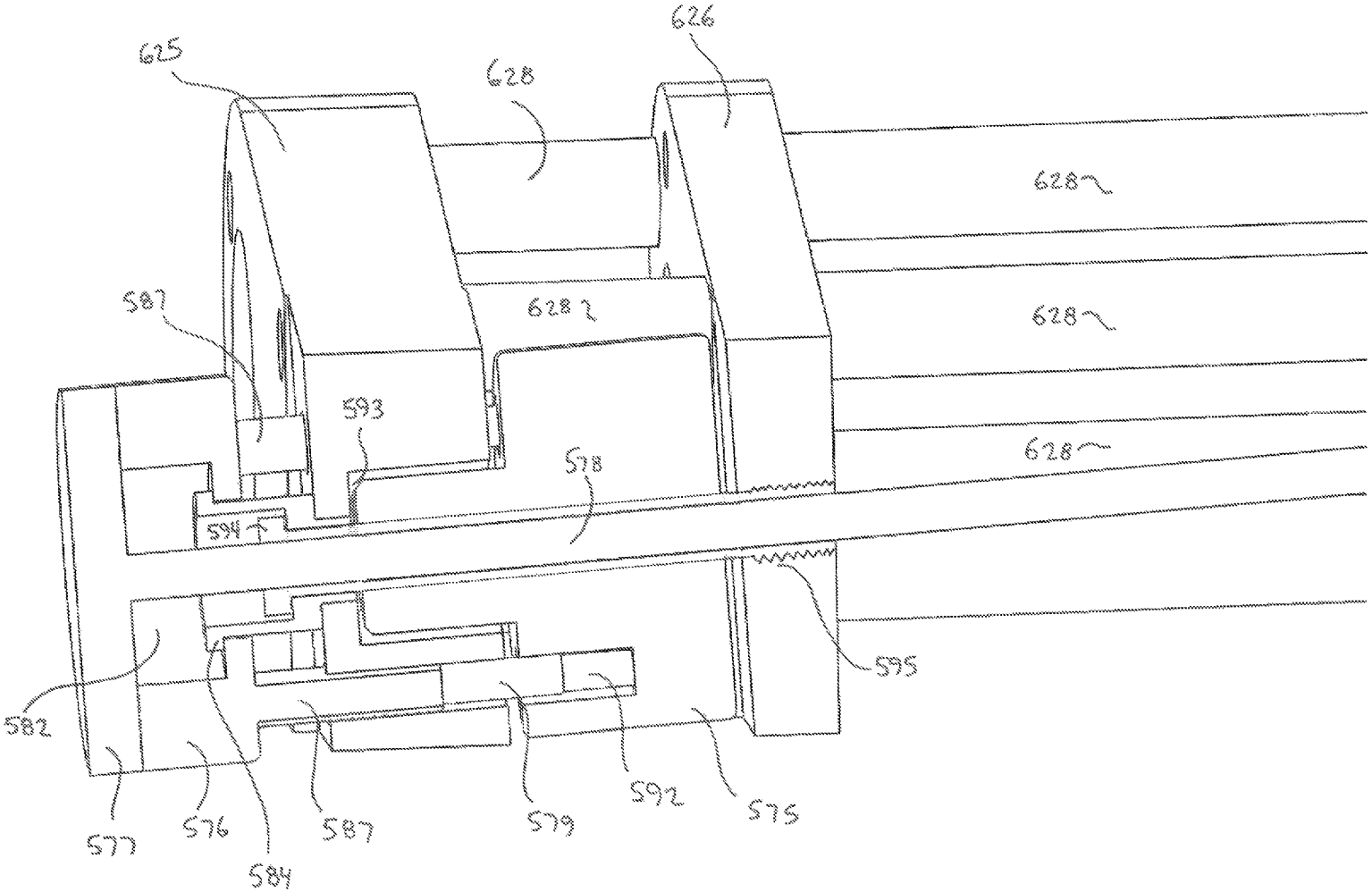
FIG. 31 is a split view of the folding joint as shown in FIG. 30 of the drawings.
Figure 32:
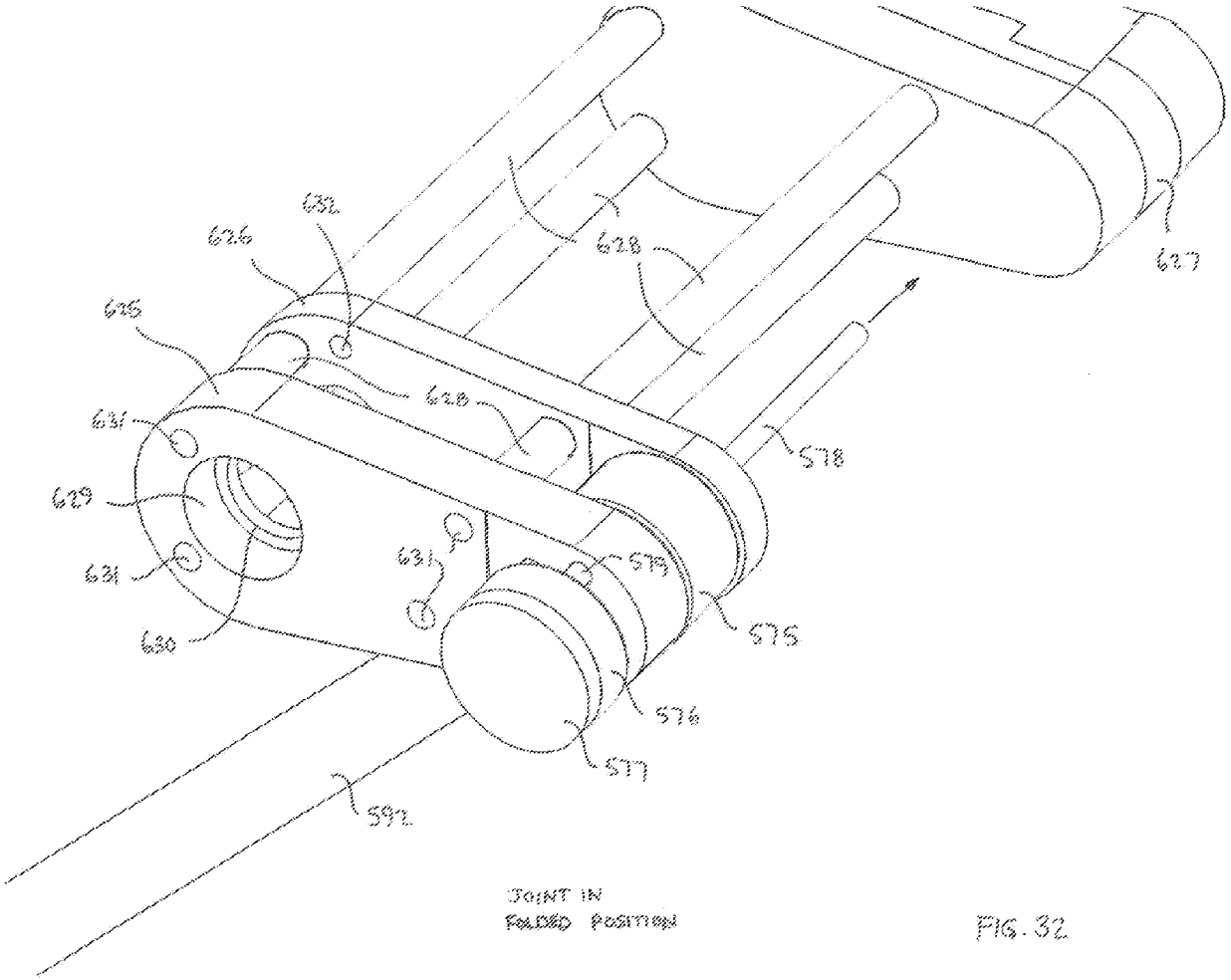
FIG. 32 is a detail perspective view of the folding joint when in the folded position.
Figure 33:
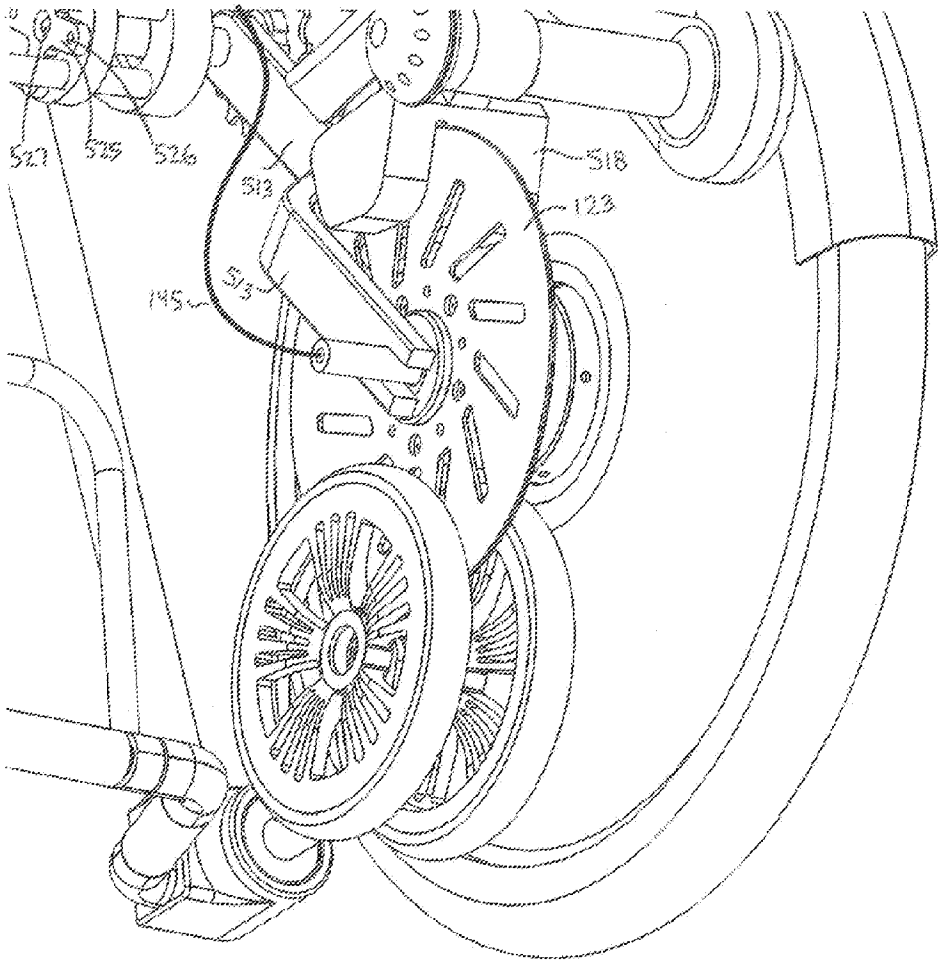
FIG. 33 is a perspective detail showing the wheelchair with the front wheel assembly in the folded position.
Figure 34:
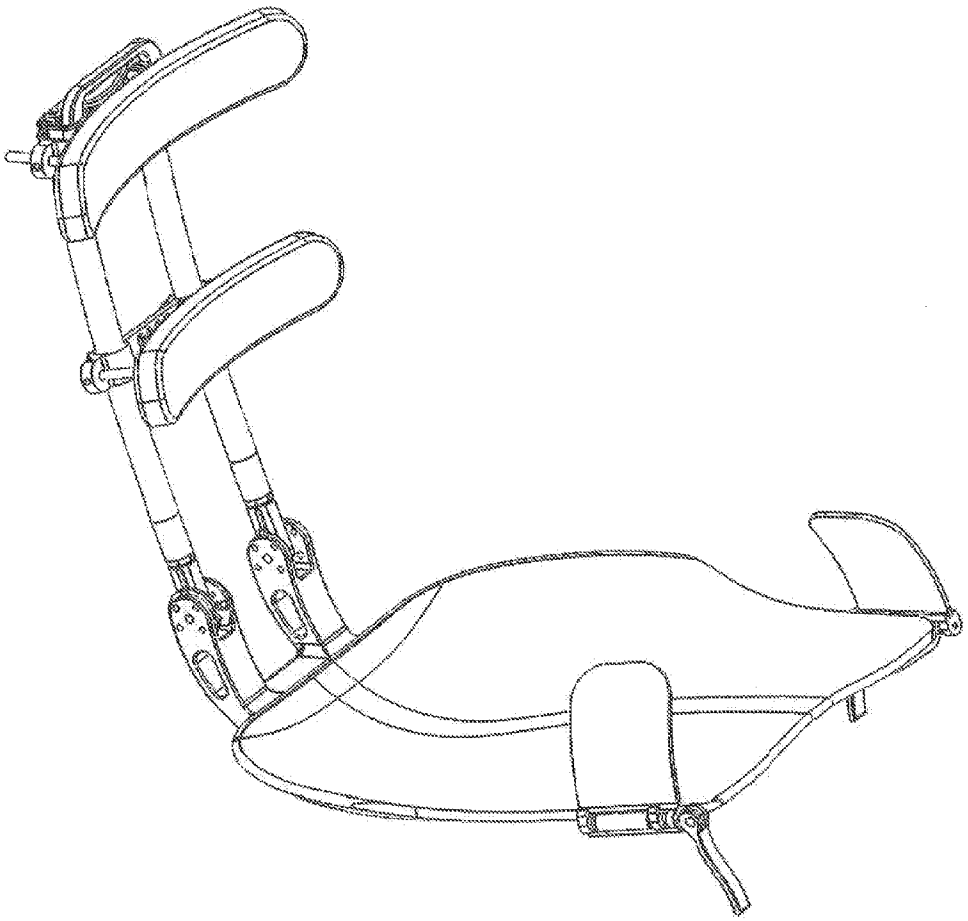
FIG. 34 is a perspective view of a seat for use on a wheelchair in accordance with the invention.
Figure 35:
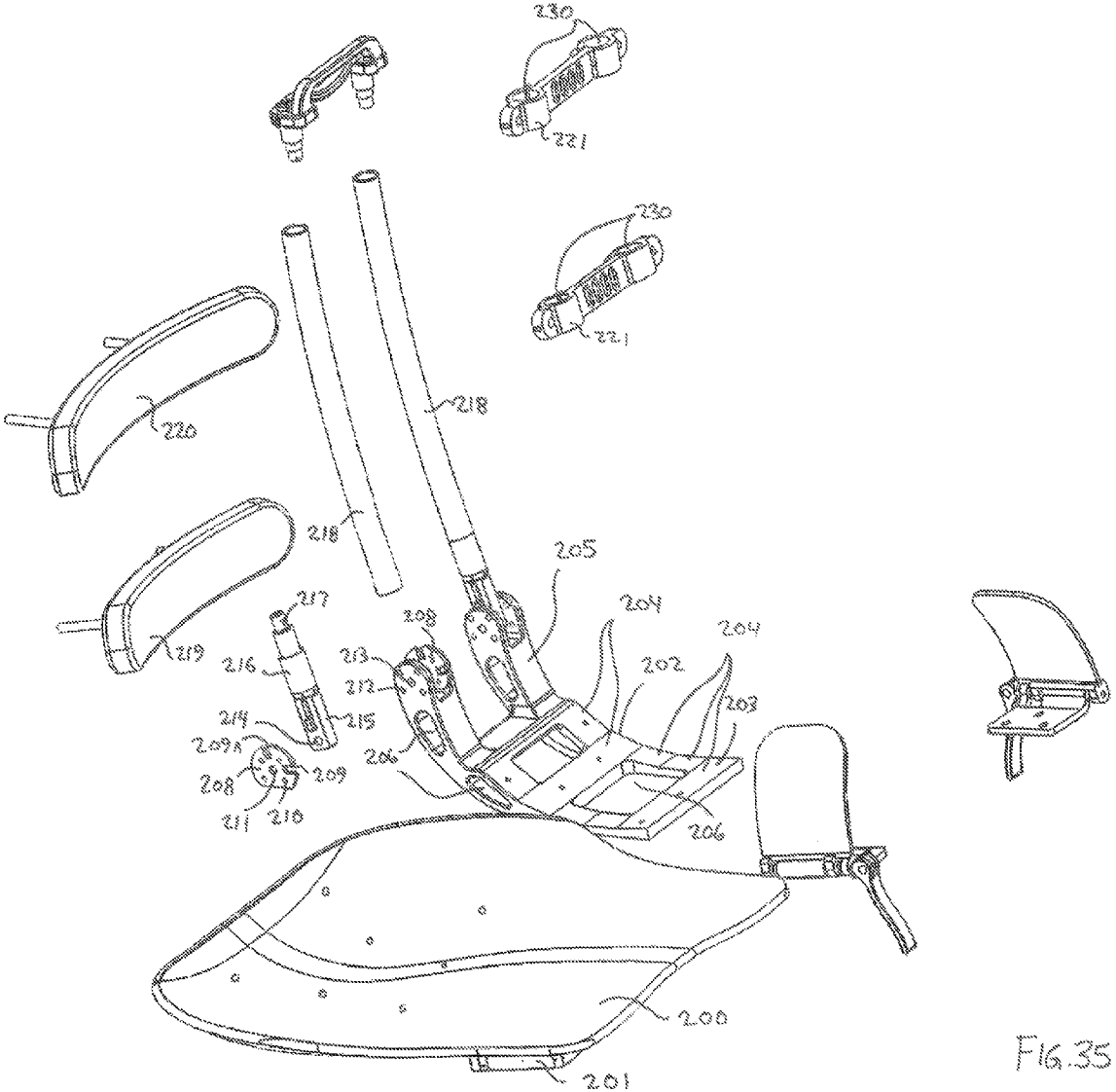
FIG. 35 is an exploded view of the seat showing the various parts and components thereof.
Figure 36:
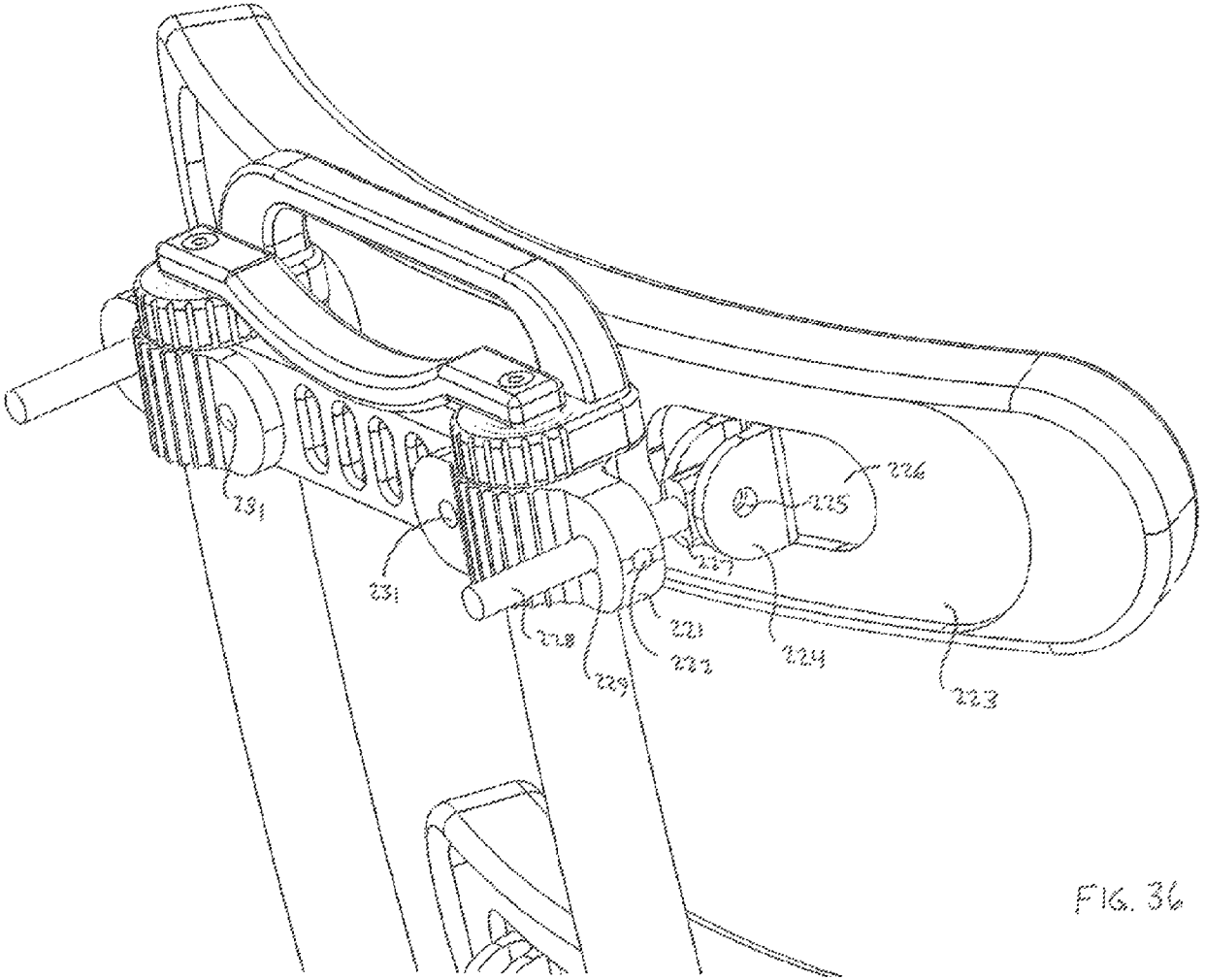
FIG. 36 is a detail view showing the back of the seat and the various mechanisms for adjustment thereof.
Figure 37:
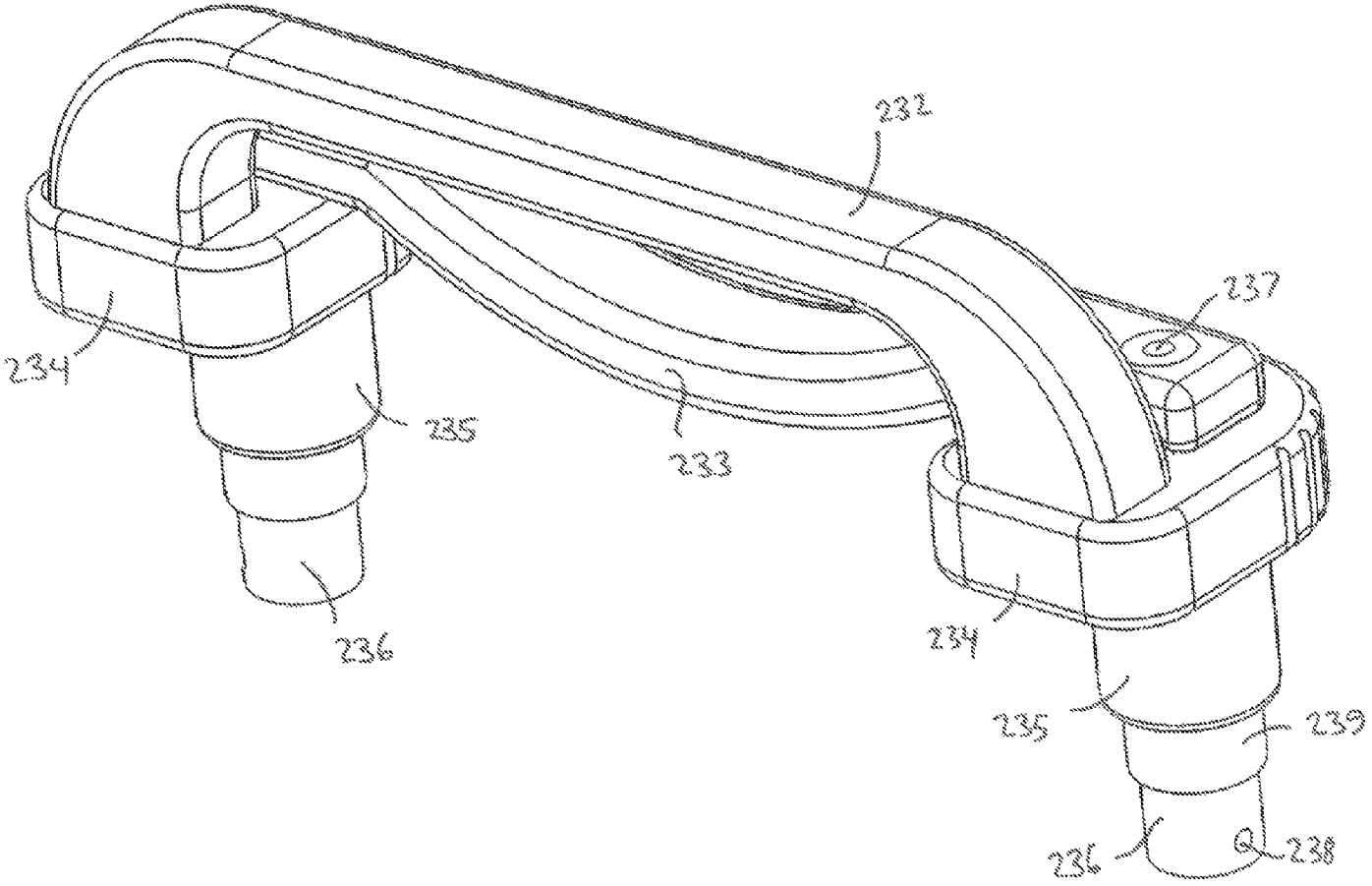
FIG. 37 is a perspective view of the parts and components relating to the seat to facilitate the unfolded and folded position of the seat.
Figure 38:
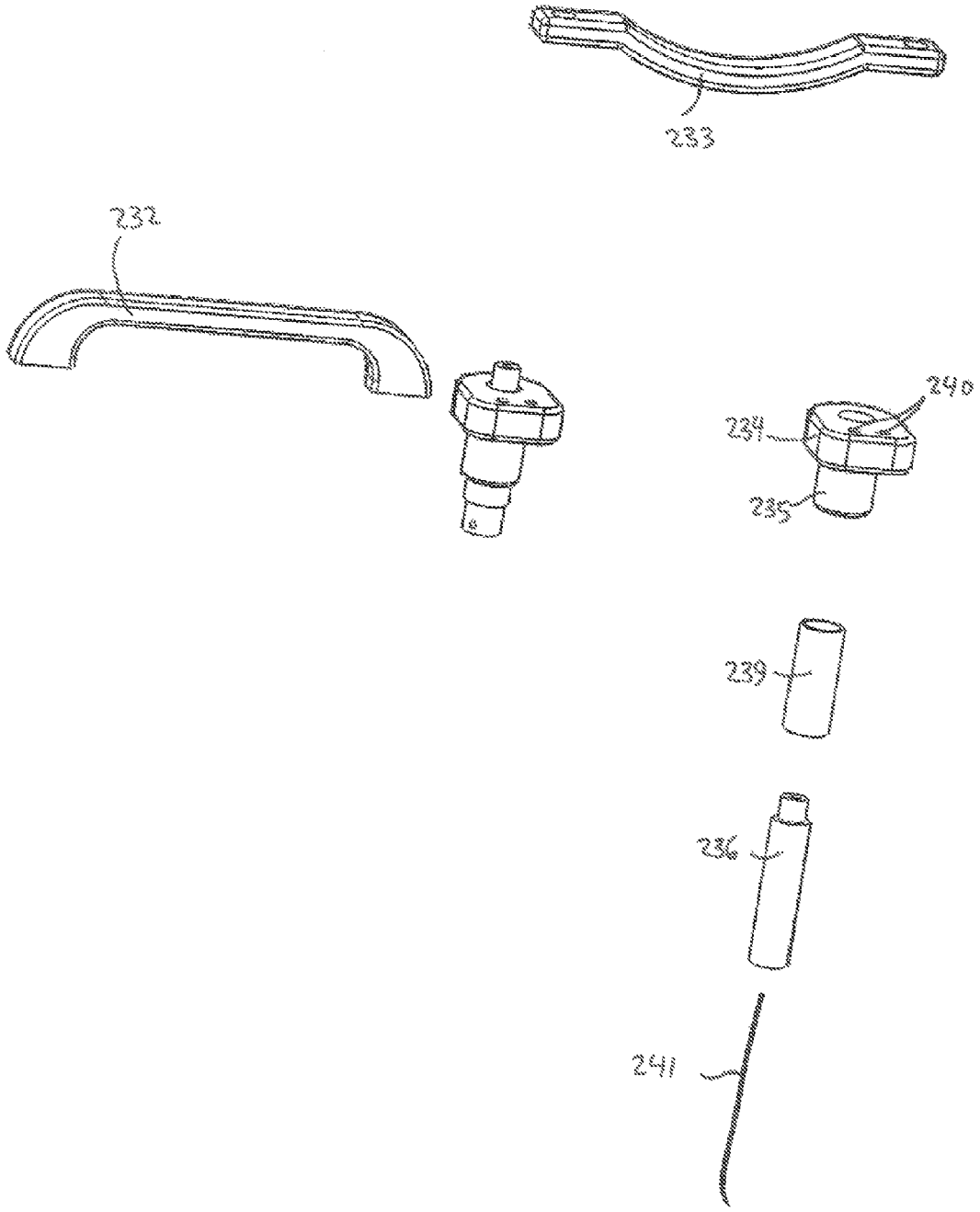
FIG. 38 is an exploded view of the parts and components relating to the seat to facilitate the unfolded and folded position thereof as illustrated in FIG. 37.
Figure 39:
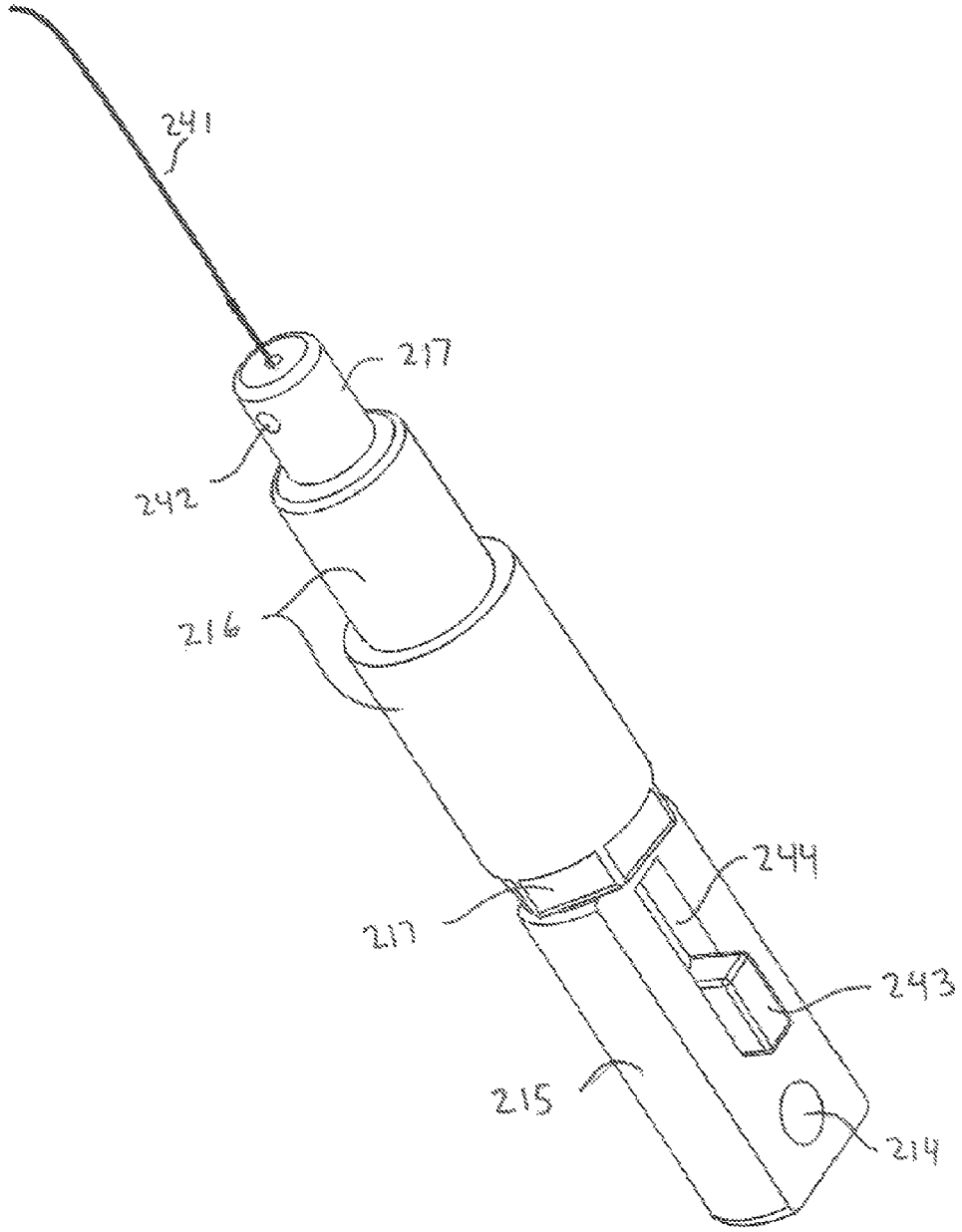
FIG. 39 is a perspective view of the seat back lower unlock handle system of a wheelchair of the invention.
Figure 40:
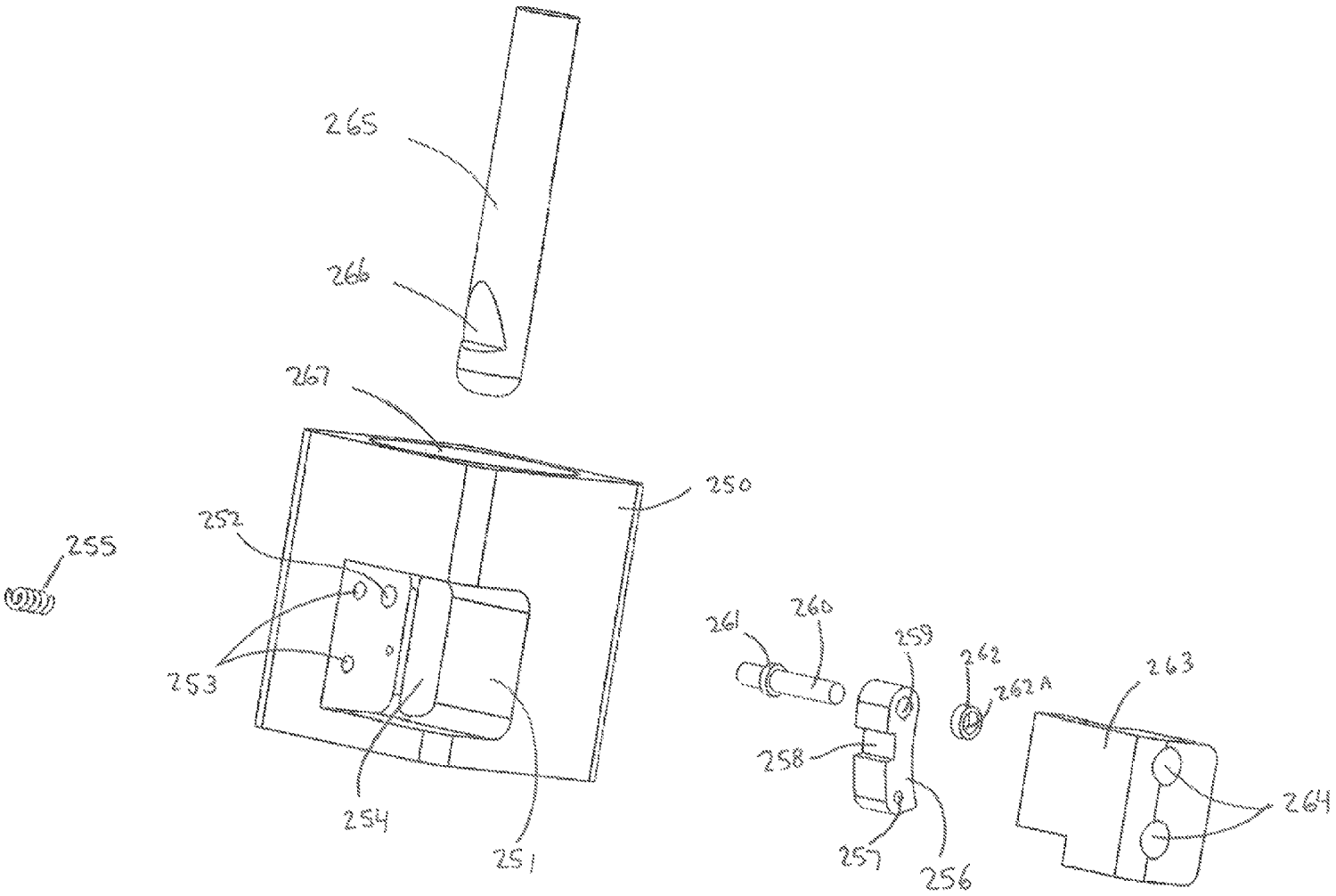
FIG. 40 is an exploded perspective view of the seat lock mechanism for attaching the seat to the frame structure.
Figure 41:
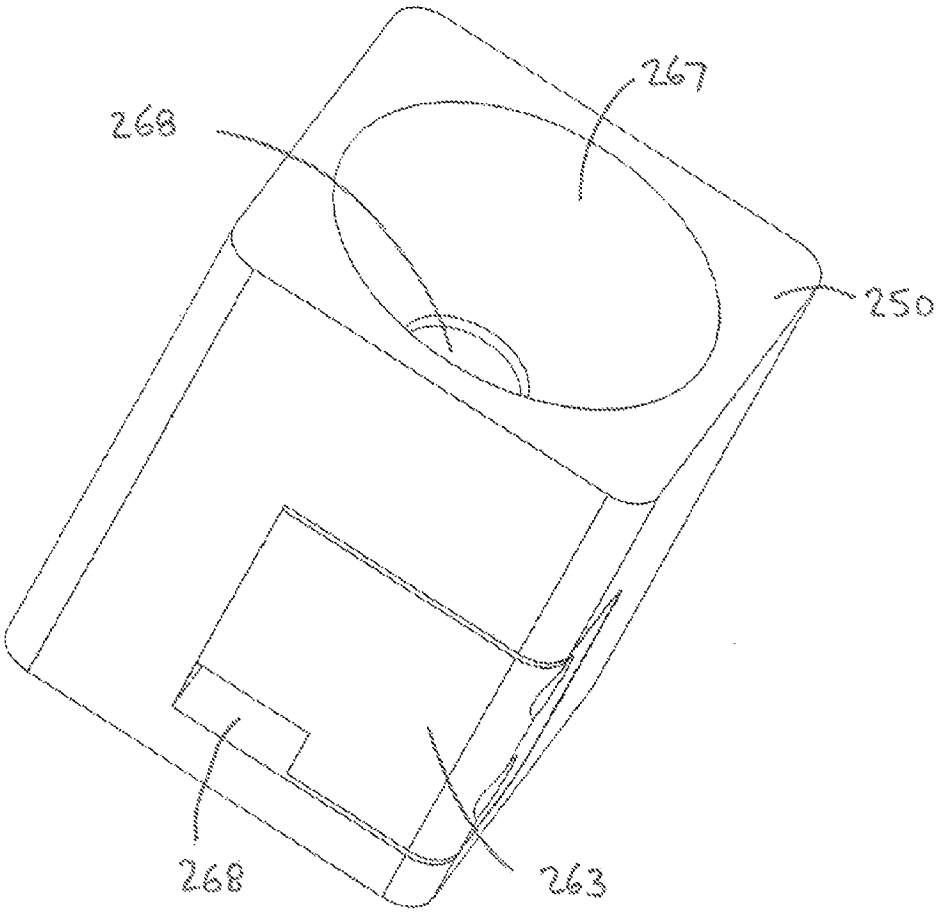
FIG. 41 is a detail of a component as illustrated in FIG. 40 of the drawings.

With reference to the drawings, there is generally shown a wheelchair 10 (see FIGS. 1 and 2, and others) of the invention comprising a number of interrelated and cooperating parts and components. Generally, the wheelchair 10 comprises a chassis 12, upon which is mounted a seat 14. Also mounted on the chassis 12 is a front wheel assembly 16, which may comprise one or two wheels.

A pair of rear wheels 18 are mounted on the chassis 12, one on each side thereof. The wheels 18 are selectively driven by the user of the wheelchair 10 by means of back-and-forth movement of arm levers 22, having a grip or handle at one end for holding by the user, and a sprocket at the other end. This sprocket is connectable to a torsion mechanism 24 by means of a chain, and the torsion mechanism 24 in turn connects to a hub and gears 30 in the rear wheel 18. By selectively operating the gears which are within the hub 30 of the rear wheel 18, as will be described below, the user of the wheelchair 10 can cause each of the rear wheels of the wheelchair 10 to be propelled in either a forward or reverse direction, or to turn the wheelchair, as the situation dictates.

The above represents an overall description of the essential components, and the description below, in conjunction with the numerous figures and illustrations, disclose details relating to each of these components, as well as their relationship and interaction.

Hub/Clutch

Reference is now made to FIGS. 4, 5, 6, 7, 8, 9, 10 and others of the drawings which show details relating to the structure and function of the rear wheel hub 30, including the clutch and gear change assembly housed therein.

The hub 30 of the rear wheel 18 is comprised of a housing which is formed by a clutch end cap 100 on the shift side, and a clutch end cap 104 on the sprocket side. The clutch sprocket 106 can be observed adjacent the clutch end cap 104. Ramp rings 101 and 102 are located between the clutch end caps 100 and 104. Each of the ramp rings 101 and 102 have pawl arm ramps 136. The pawl arm ramps 136 formed on the ramp rings 101 and 102 have different or opposing directions. When the pawl arm ramps 136 on the ramp ring 102 are engaged with the pawl arms 122, as will be described below, the wheelchair 10 will be propelled in a forward direction. Conversely, when the pawl arm ramps 136 on the ramp ring 101 are engaged, also to be described below, the wheelchair 10 will be propelled in a reverse direction.

A rear wheel collar 103 is attached to the ramp ring 101, and a ramp ring collar 105 is provided outside and adjacent the clutch end cap 104. The rear wheel collar 103 and the ramp ring collar 105 will be attached to the rear wheel 18, as will be seen in other figures. The clutch sprocket 106 is mounted on a clutch sprocket mounting sleeve 107.

An axle 108 extends through the hub, including the clutch end caps 100 and 104, the ramp rings 101 and 102, as well as the clutch sprocket mounting sleeve 107 and clutch sprocket 106. Case bearings 118 and 119 are formed at each end of the hub in the clutch end caps 104 and 100 respectively. The axle 108 is held by and extends through these case bearings 118 and 119, and is attached to the swing arm with fastening means utilizing the external threads at both ends.

Within the hub, there is an inner clutch slider 120, including an internal slot 139 therein, the slot 139 receiving a shift pull post 113. Appropriate maneuvering of a cable 145, to be described, allows the shift pull post 113 to move axially within an axle slot 109 formed in the axle 108, and the position of the shift pull post 113 within the internal slot 139 causes movement of the inner clutch slider 120, causing hardware, as will be described, to move within the hub to allow selective engagement of either the ramp ring 101 or 102, which results in the forward or reverse direction propulsion of the wheelchair, as mentioned above.

The inner clutch slider 120 includes a shoulder 144, and a pair of inner clutches 121 formed on the inner clutch slider 120. The inner clutches 121 includes three pawl arms 122 per inner clutch which engages the pawl arm ramps 136 in the ramp rings 101 and 102 respectively. The axial movement of the inner clutch slider 120, as operated by the user, causes axial movement of the inner clutch 121, thereby selectively engaging the pawl arm ramps 136 in ramp ring 101 and 102 respectively so as to effect forward or reverse motion of the wheelchair.

The axle 108 holds an axle sleeve 141. The axle 108 has an axle through hole 138. Further, the axle 108 comprises an axle flange stop 110 and axle flange shoulder 111. The previously referenced axle slot 109, through which the shift pull post 113 radially projects, is able to move axially within the axle slot 109, extend into the internal slot 139 of the inner clutch slider 120, and effect change of direction of movement of the chair. A shift shaft 112 is located and slides within the axle through hole 138, and the shift pull post 113 threadedly attaches to the shift shaft 112 as shown. A shift spring 114 is provided to provide the biassing force on the shift shaft 112, and is held in position by a spring retainer block 115.

The shift shaft 112 and shift spring 114 are housed within the axle through hole 138 of the axle 108. The shift pull post 113 extends outwardly through the axle slot 109. A pair of clutch axle bushings 117 are provided, and an axle stop bushing 116 is provided between the axle flange stop 110 and one of the clutch axle bushings 117. The axle sleeve 141 is then mounted over the clutch axle bushings 117 on the axle 108.

The inner clutch slider 120 is then mounted over the axle sleeve 141, and positioned such that the shift pull post 113 is received within the internal slot 139. The case bearing 119 is positioned over the axle 108, and the axle bearing 118 is positioned over the axle sleeve 141, and the axle 108 passes therethrough. The hub with its various components as described above, and to which is attached to one of the rear wheels 18 of the wheelchair 10, is capable of rotating about the axle 108.

The inner slider clutch 120 comprises two inner clutches 121, each of which has three pawl arms 122 mounted by means of a pawl post 122*a*. One inner clutch 121 has pawl arms 122 which engage with the pawl arm ramps 136 on the ramp ring 101, while the other inner clutch 121 has pawl arms 122 which engage with the pawl arm ramps 136 on the ramp ring 102. These ramp rings 101 and 102 effect respectively forward or reverse direction of movement of the wheelchair when the arm levers are moved. The pawl arms are kept in tension by a collar spring. Only one of the inner clutches 121 will be in contact with pawl arm ramps 136 on the ramp rings 101 or 102 at any one time. The axial sliding of the inner clutch slider 120 between its first and second positions, corresponding to forward and reverse motion of the wheelchair, will cause either selective engagement with one such pawl arm ramp 136 or the other. The inner clutch 121 not driving a ramp ring 101 or 102 will be idle in the sense that it does not have any active driving capacity at this point. For an example of this, please see the figures which show the inner clutch 121 in contact with the ramp ring 102, but not with the ramp ring 101.

By means of an adjustable cable which forms part of the arm lever, and which will be described further below, the user of the wheelchair 10 causes the inner clutch slider 120 to move axially over the axle sleeve 141 and around the axle 108. This is achieved by the axial movement of the shift pull post 113 engaging in the internal slot 139 of the inner clutch slider 120 and moving it so that an inner clutch 121 on the inner clutch slider 120 selectively engages the pawl arm ramps either on the ramp ring 101 or the ramp ring 102. Since these respective ramp rings 101 and 102 have oppositely directed pawl arm ramps 136, the movement of the arm lever will have opposite effects depending upon whether the inner clutch slider 120 is engaged with either one of these ramp rings 101 or 102. Therefore, forward or reverse motion of the wheelchair can be achieved by operation of the cable and the selective positioning of the inner clutch slider 120 according to the direction of movement designed by the user.

Rear Wheel Arrangement

Reference is now made to the FIGS. 8, 9, 10, 11, 12, 13, 14, 15, 16, 17, and others, which show the attachment of the rear wheel 18 to the gear and hub assembly 30. These figures show the wheel plates 400, and inner and outer plates fastened together around the perimeter via bolts 405 through holes 404, and also connected to the hub 30 via bolts 406 though holes 403 in the rear wheel collar 103 and ramp ring plate 105, thus connecting the wheel plates together and to the hub 30.

Also shown is the wheel tire 401, and a fender 402 which may be positioned thereover. The wheel and hub assembly is connected by means of a pair of swing arms 510, including an inner swing arm and an outer swing arm respectively on the inside and the outside of the wheel and hub assembly via fasteners through the wheel collar mounting holes 124 into mounting holes 125 as well as via fasteners through small ramp ring plate mounting holes 130 into clutch end cap mounting holes 128. As will be appreciated, the hub 30 contains the hardware mechanisms for driving the wheel, shifting gears, and achieving forward and reverse movement.

Also shown in these figures is a braking system including a disk and caliper arrangement, to be described further below.

Drive Train and Torsion Mechanism

The drive train torsion mechanism of the wheelchair propagation system will now be described, as illustrated in FIGS. 3, 8, 11, 12, 13, 14, 15, 16, 17, and others. The torsion mechanism 24, as will be appreciated from previous description, comprises an intermediate structure between the clutch hub arrangement within the rear wheel 18, as already described, and the arm lever 22, particularly the sprocket thereof, of the wheelchair 10. The torsion mechanism is thus connected to both the sprocket of the arm lever, on the one hand, and the clutch hub mechanism in the rear wheel, on the other, thereby facilitating the back-and-forth motion of the arm lever into driving energy for rotating the rear wheel 18, in either the forward or reverse direction, through the hub clutch mechanism.

The torsion mechanism 24 comprises a torsion shaft 500 including a threaded through hole 504 and a splined end 528. A torsion shaft bearing shoulder 515 surrounds a part of the torsion shaft 500. A torsion outer housing 501 is provided, and includes a shoulder 506 on each side, and a series of slots 502 associated therewith upon which a sprocket 511 is received at mounted. The sprocket 511 has an opening 514 which fits over the end of the torsion outer housing 501, and one or a series of sprocket mounting tabs 513 projecting into the opening 514 engage with corresponding or registering slots 502 on the torsion outer housing 501.

A pair of bearings 505 fit over the torsion shaft 500 and support the torsion outer housing 501.

Threaded end nuts are provided to secure the sprockets 511 onto the torsion bar outer housing 501, and these threadedly engage with correspondingly threaded ends of the torsion outer housing 501.

The torsion shaft 500 is received in and connected to the chassis portion of the wheelchair 10, and is mounted within an outer main support 625 and an inner main support 626, which are joined together by support tubes 628. The torsion shaft 500 is supported within the outer main support 625 by means of a torsion bar bearing 633 and the splined end 528 is received within the fixed splined module 525. The end of the torsion shaft 500 opposite that to the splined end 528 is received within the swing arm 510, the other end of the swing arm 510 being connected to the axle of the rear wheel hub mechanism located in the center of the rear wheel 18.

The torsion shaft 500 itself allows the rear wheel to have movement up and down much as cars have suspension. The torsion shaft 500 is mounted firmly at one end with splines 528 interlocked with splines 527 set inside a fixed module 525 and supported by bearings 633. The swing arm 510 is fixed to the shaft 500 and utilizes its length to incur "twist" in the shaft 500. The shaft 500 is preferably of a material that constantly returns to its original state and allows for the swing arm 510 and the rear wheel 18 to move fluidly as the wheelchair 10 may traverse terrain which may not be smooth.

Located about the shaft 500 is a torsion outer housing 501 which is free to spend in either direction and allows the arm lever motion to be transferred via chains and sprockets from an inboard line of motion to a more outboard line of motion, or transferred across the outer housing 501 which is rotating on bearings 505, and supported by the torsion shaft 500. In this way, the torsion shaft 500 is supporting two different actions, namely, motivation and suspension.

An arm lever 553 having a lower end is connected to an arm lever shaft 550. The arm lever shaft 550 is supported by the arm shaft block 555. The arm sprocket 551 is mounted over the arm lever shaft 550, and has a plurality of teeth 552. The arm sprocket 551 is connected by a chain to the first sprocket 511 on one side of the torsion outer housing 501. The sprocket 511 on the other side of the torsion outer housing 501 is connected by a chain to the clutch sprocket 106, details of which have been described above.

Arm Lever

As will be seen from the drawings, including FIGS. 1, 2, 11, 16, 17, 18, 19, 20, and others, the arm lever 553 extends upwardly from its mounted position on the arm level shaft 550, and includes an access cover 558 around the main push handle body 557. A push handle 565 extends transversely outwardly from the arm lever 553 so that it is inwardly directed with respect to the wheelchair 10 so as to provide easy access to the push handles 565 by the user. At the end of the push handle 565 there is formed a gear shift knob 566 which can be rotated by the user to change which inner clutch and pawl arms engage in the hub portion in the rear wheels, so that appropriate selection can be made to the forward and reverse motion of the wheelchair. Details as to how this may be achieved have already been described in detail above with reference to other figures and drawings.

Internal cable rollers 559 and 560 are provided, and rotation of the gear shift knob 566 alternatively tensions or slackens the cable which extend from the internal cable roller. This cable extends through a shift cable alignment groove 571, and extend through the arm lever 553 and are appropriately directed to the gear and hub mounted in the wheel of the wheelchair. The rotation of the gear shift knob 566 therefore achieves, through the presence of the cables, the ability to effect movement of the inner clutch slider 120 to change gears, as described, to selectively achieve forward or reverse motion.

Handle Structure and Operation

Reference is now made to FIGS. 18, 21, 22, 23, 24, 25, and others, showing the handle structure and operation. This is one embodiment, and other versions or variations of this arrangement will also fall within the scope of the invention. The handle is positioned on the arm lever 553 for operation by the user, preferably extending inwardly from the arm lever 553, and positioned in a convenient location for the comfort and easy operation of the user.

The handle is comprised of a pivot joint block 530, and internal slider 533, and an internal fixed locator 537. A spring 532 is positioned between the pivot joint block 530 and the internal slider 533 so as to urge the internal slider 533 away from the pivot joint block 530 in the normal course. The pivot joint block 530 comprises a lock mounting extrusion 531 and a spring floor 530A which forms a base or shoulder for one end of the spring 532.

The internal slider 533 is a generally cylindrical structure having a shoulder stop 534 at one end thereof, and axial lock grooves 535 extending down its length on the outer surface thereof. A through hole 536 is provided for receiving various cables extending between the handle and the gear assembly so that the user can select forward movement, reverse movement, or a neutral position. The shoulder stop 534 forms the other surface for receiving the spring 532.

The internal fixed locator 537 comprises four substantially equispaced pivot lock engagement tabs 538, each of the tabs 538 being received in a corresponding lock groove 535 on the internal slider 533. In one operating configuration, the engagement tabs 538 are received within the lock grooves 535 formed in the shoulder stop 534, thereby preventing rotation of the internal slider 533 in this position. The internal fixed locator 537 further comprises a through hole 539 for the cables, as referenced above, and threads 537A on the outer circumferential surface thereof.

A push handle main body 557 and the access cover 558 thereof are attached to the internal fixed locator 537, and the pivot joint block 530 attaches to the arm lever 553. A space 533B is provided, and is of a size which is sufficiently large so that the axial movement of the handle toward the arm lever has the effect of sliding the internal slider 533 so that the engagement tabs 538 of the internal fixed locator 537 become disengaged from the lock grooves 535 in the shoulder stop 534. The axial movement of the internal slider 533 is against the bias of the spring 532, so that the spring 532 would in the normal course urge engagement between the tabs 538 and grooves 535 when they are suitably aligned. However, when the tabs 538 and grooves 535 are disengaged and nonaligned, the handle can be rotated up to about 90 degrees relative to the arm lever 553 allowing clearance when the chair is folded. In the folded position after a 90 degree rotation, the tabs 538 can re-engage in the grooves 535 to lock the handle in that configuration.

As mentioned above, the mechanism for rotating the handle as described above is just one of several which can be used in accordance with the invention, which is not limited to this specific configuration.

Front Wheel Assembly

The front wheel assembly 16, as seen in FIGS. 1, 2, 28, 29, 30, 31, 32, 33, and others, is attached to the chassis 12 of the wheelchair 10 by means of a pair of forward down tubes 592. The attachment of these forward down tubes 592 to the chassis 12 is achieved in such a way that the front wheel assembly 16 can be retracted, folded, under the chassis 12 so as to render the wheelchair in to a more compact and more easily transportable configuration. Further details relating to the mechanism for compacting or folding the front wheel assembly 16 will be provided below with reference to other figures.

Each of the forward down tubes 592 at their ends remote from the connection to the chassis 12 is attached to a caster module 355. Extending inwardly and laterally from each caster module 355 is a frame joint 308, attached to a substantially frame vertical tube 307. A frame lower tube 306 connects each of the respective frame vertical tubes 307, including frame joints 305 and a pair of frame pivot collars 304.

A foot rest platform 300 is attached to the frame lower tube 306, and includes foot rest vents 301, ports 302, a heel separator support 303, a foot rest pivot tube 309, and such other hardware that may be included for the users comfort and convenience.

Extending downwardly from each caster module 355 is a caster stem main body 362 which connects to the caster module 355 through a pair of caster module bearings 358 pressed into a caster module 355 at top and bottom openings. The caster stem main body 362 includes an upper caster stem 360, having threads 361 for attachment through a securement of a caster module. The lower end of the caster stem main body has attached thereto a pair of front swing arms 366 mounted thereto by a pin or bolt extending through holes 367 and 365. The front swing arms have apertures 368 therein for receiving the front axle 372, which includes the front axle shoulder 373. A pair of front wheels 353 each having their own front tire 354 is mounted on the front axle 372 at each end thereof, with appropriate additional hardware such as the front axle spacer 370, front wheel bearing, and cap 377 to facilitate the connection. A spring 379 extends from the spring attachment notch 363 on the main stem body 362, and the opposite end of the spring is received within the spring hole 369 on the front swing arms 366.

As will be noted from the above construction, the attachment of the front wheels through the swing arm 366 and associated spring 379 provides a front suspension system for a smoother ride. The front wheels will be capable of some limited up and down rotational or pivotal movement, in response to encountered irregularities or bumps on the riding surface, against the bias of the spring 379. The spring would return the wheels to their substantially normal position once the irregularity has been traversed.

The caster module 355 includes a headlight housing, which encloses the tip of the caster module 555, and also contains a headlight port 326 and one or more headlights 327.

Front Wheel and Foot Rest Folding Mechanism

As briefly alluded to above, the front wheels and frame assembly, as seen in FIGS. 1, 2, 26, 27, 28, 29, 30, 31, 32 and 33, and others, may be folded underneath the seat and chassis in order to compact or fold the wheelchair to thereby make it more convenient for storage and transportation.

As shown in the figures, a pivot lock module 575 attaches between the outer main supports 625 and 626 of the right side chassis. The pivot lock module 575 includes a series of pin and spring recess holes 589 for receiving a series of pins 579. Pivot axle bolt holes 581 and 582 are formed in the outer main supports 625 and 626, and a pivot lock module pull post rod 578 extends from the pivot lock pull post hat 577, passing through the pivot axle bolt hole 581, the hole 591, and finally through the hole 592. An extension 588 connects to the forward down tube 592 which is the main support for the front wheel assembly. Rotating and pivoting the tube 592 would of course result in the rotation, pivoting and folding of the front wheel assembly.

A pull cable limiting cup 584 is mounted about the pull post rod 578, and has a shoulder 585, as well as an alignment shoulder 586. A pin lock release module 576 is provided having push legs 587, and these act on the pins to push them into disengagement from the pin lock holes 580. When the pins are in the pin lock holes 580, rotation of the down tube 592 will be prevented. By pulling on the pivot lock pull post hat 577 and rod 578, the pins by the action from the springs will be pushed out of the pin lock holes 580, allowing rotation and folding or unfolding of the down tube 592. The down tube 592 can be rotated from completely open (the usable position) to completely closed (the stored position) positions only.

Seat Structure

The wheelchair 10 comprises a seat 14 for accommodating the user. See FIGS. 1, 2, 34, 35, 36, 37, 38, 39, 40 and 41 and others. The seat 14 is in many respects adjustable to suit the specific physical requirements of the user, so as to provide good comfort and positioning for propelling the wheelchair. Further, the seat 14 is configured with the arm lever so that the arm levers are in positions which may be best suited for grasping by the user and propelling the wheelchair. Further, the seat may include components and mechanisms which allow it to be folded and/or removed so as to make the wheelchair easier to store or transport by occupying a smaller footprint.

In one embodiment of the invention, there is shown a seat arrangement which includes a seat bottom 200 including a bolster mount pad 201. An arrangement of lock seat joint 202, including various openings 206 to make the seat lighter, are provided and the seat bottom 200 is appropriately mounted on the lock seat joint 202. The structure may include mounting flat pads 204 for improved mounting and stability.

A pair of raiser arm pods 205 extend upwardly from the lock seat joint 202. Each of the raiser arm pods 205 is connected to an upwardly extending steel tube 218 by means of a lower lock tube 215 and an upper lock tube 216. The lower lock tube 215 connects to the raiser arm pods 205 through lock discs 208, the lock discs 208 including axle mounting holes 211, mounting holes 210, as well as a pair of lock slots, one of the lock slots 209 being utilized when the seat is in the folded position and the other of the lock slot 209*a* be utilized when the seat is in the open or user position.

The pair of seat tubes 218 support a lower seat support pad 219 and an upper seat support pad 220, which may be cushioned and are adjustably located on the seat tubes 218 to best meet the physical comforts and shape of the user's body. The adjustability of these seat support pads may not only allow the up-and-down movement thereof over the seat tubes 218, but they may also be adjustable so that they can be moved backward and forward relative to the seat tubes 218 to meet the physical requirements of a specific user. They may also be adjustable in degrees, such as 90°, 117°, 62°, etc. (90° being generally vertical to the ground) to further meet the individual user's physical requirements.

The seat structure further comprises a pair of support or bolster arms near the forward end of the seat bottom 200. These arms are designed for helping to keep the legs of the user confined and stabilized on the seat bottom, and may be maneuverable between a myriad of positions, for example from about 90° straight up moving 45° toward the center of the seat with each degree change making the bolster to seat relationship smaller and thus tighter for more confinement of thinner legs of a user. In a further position, the arms may be folded away or downwardly directed when not is use so as to make user access to the seat of the wheelchair easier when getting into or out of the seat. This will be described in further detail in a separate section below.

At the top of the seat tubes 218, there is formed an operating mechanism in contact with the other structure on the chair, and by means of which the seats may be tilted and folded around the lock disk, enabling the seat back to move between its extended user position and the folded storage and transportation position. A seat lock module 234 is provided at the top of each seat tube 218 and a seat lock module insert 235 is provided and connected to a pull rod 236, which slides through 235 via bushing 239. A brace handle 232 is formed on the seat lock module. Also provided is a pull handle 233. The pull handle 233 can be pulled outwardly or upwardly, and the brace handle 232, being in a fixed position, may be used as a counterforce and grip to facilitate the folding and unfolding operation of the seat back.

The pull handle 233 connects to the pull rod 236 in the seat tube 218. The pull rod 236 attaches to an unlock cable 241, which at its other end attaches to a lock pull rod 217. This comprises an upper lock tube 216 and a lower lock cube 215. The lower lock tube 215 includes a seat lock block 243 which moves up and down in response to the pulling on the cable 241 within a seat lock block slot 244. When the seat lock block 243 is in its lower or normal rest position, it is able engage within one of the lock slots 209 or 209*a*. If the seat back has been tilted into its operating or unfolded position, the seat lock block 243 will be received within the lock slot 209*a*. This will fasten the lock discs to the seat joint arm pods 205, and secure the seat back in the generally operational position. When it is designed to fold the seat back, the pull handle 233 is raised, and through the action of the various components including the cable, the seat lock block 243 will slide upwardly in the seat lock block slot 244, and out of the lock slot 209*a*. The seat back is then free to rotate into the folded position, and when the folding has reached a sufficient degree, the lock slot block 243 will step into the lock slot 209 so as to keep the seat back in this folded position, until the user needs the wheelchair once more, and the seat back is unfolded by carrying out the generally reverse procedure described above.

A further figure of the seat release mechanism for unfolding and folding the seat back illustrates some of the additional components, including bushings and spread nuts.

In another embodiment, there is shown a seat lock block 250 including a seat lock block access port 251, which operates in association with a seat lock mounting post 265 which has an engagement notch 266. The seat lock mounting post 265 is received through a tapered opening 267 in the seat lock block 250 so that it can attach thereto. An access block 263 is received within the access port 251, and a toggle arm 256 is attached between the seat lock block 250 and the access block 263 by means of a toggle arm axle 260, one end of which is received in the axle mounting hole 252, the other in an axle mounting hole within the access block 263. A shoulder 261 on the toggle arm axle 260 is provided. Further, a toggle arm spring 255 provides the necessary force to keep the toggle arm 256 positioned. The mechanism further comprises a hole 254, extending between the access port 251 and an access opening 268, and allows the toggle arm 256 to engage the notch 266 in the seat lock mounting post 265. The post is attached to the seat and the block is mounted to the frame structure. The post/seat is lowered into the hole in the block and the spring loaded arm lever is pushed out of the way until the post lowers significantly allowing the lever to reengage the notch in the post thus locking the post/seat in place. The lever is disengaged via a cable actuated by a lever.

When the seat mounting post is downwardly inserted into the seat lock block opening, a plurality of seat mounting blocks are securely attached to the seat support structure. A plurality of seat lock mounting posts are secure 265 are securely attached to the seat joint.

Seat Bolster Flap

Figure 42:
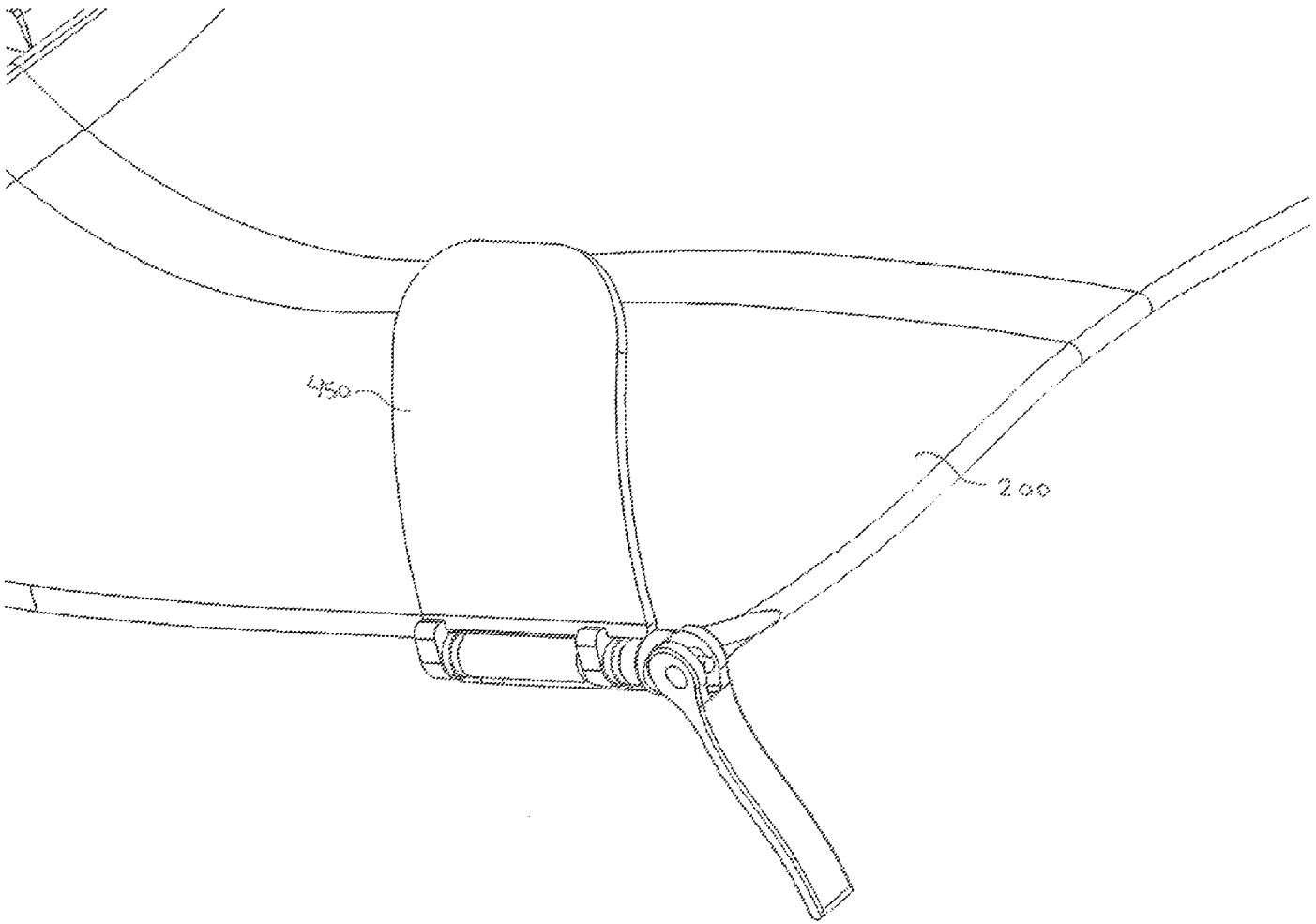
FIG. 42 is a front view of a seat bolster for use with a wheelchair in accordance with the invention.
Figure 43:
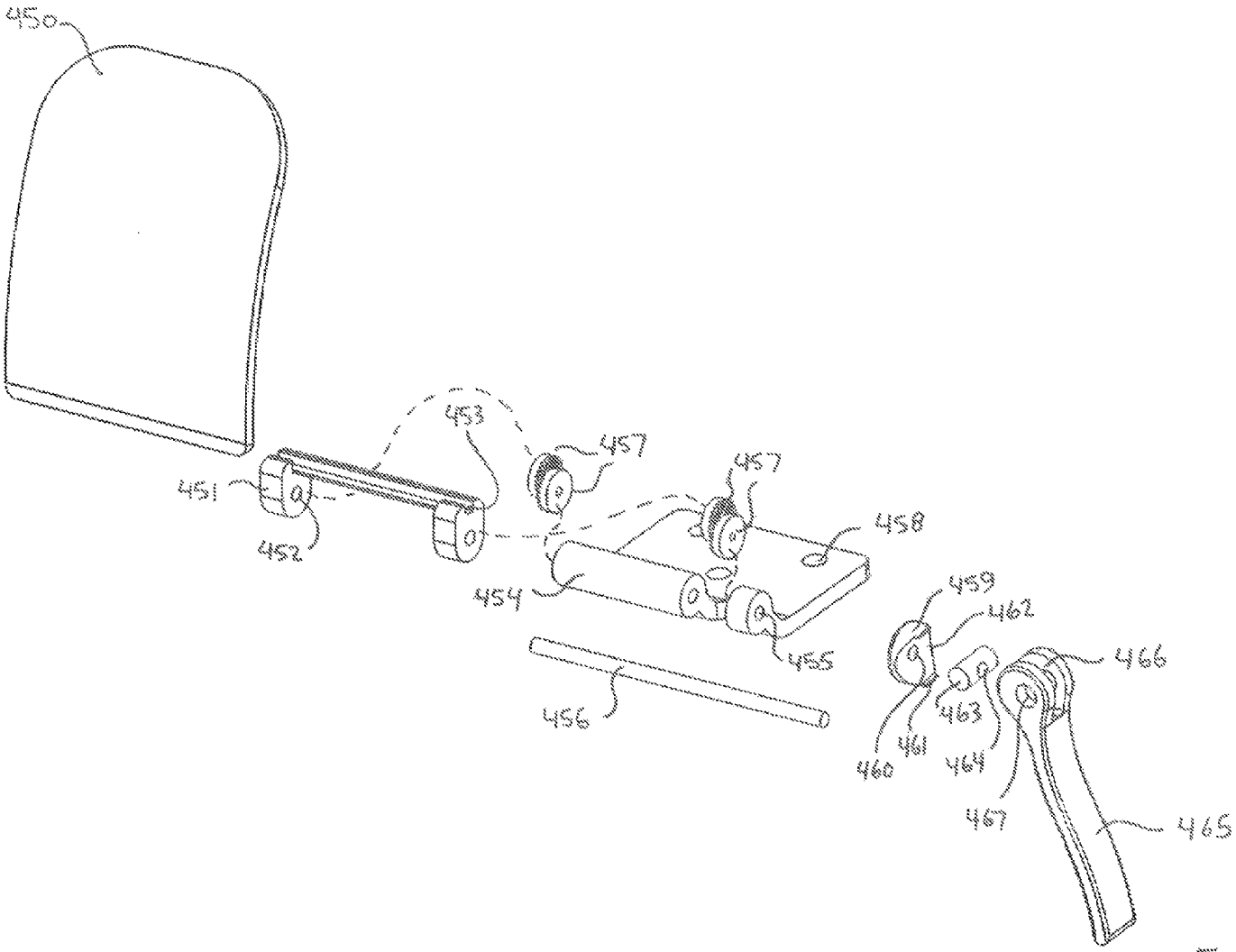
FIG. 43 is an exploded view of the seat bolster as illustrated in FIG. 42 of the drawings.
Figure 44:
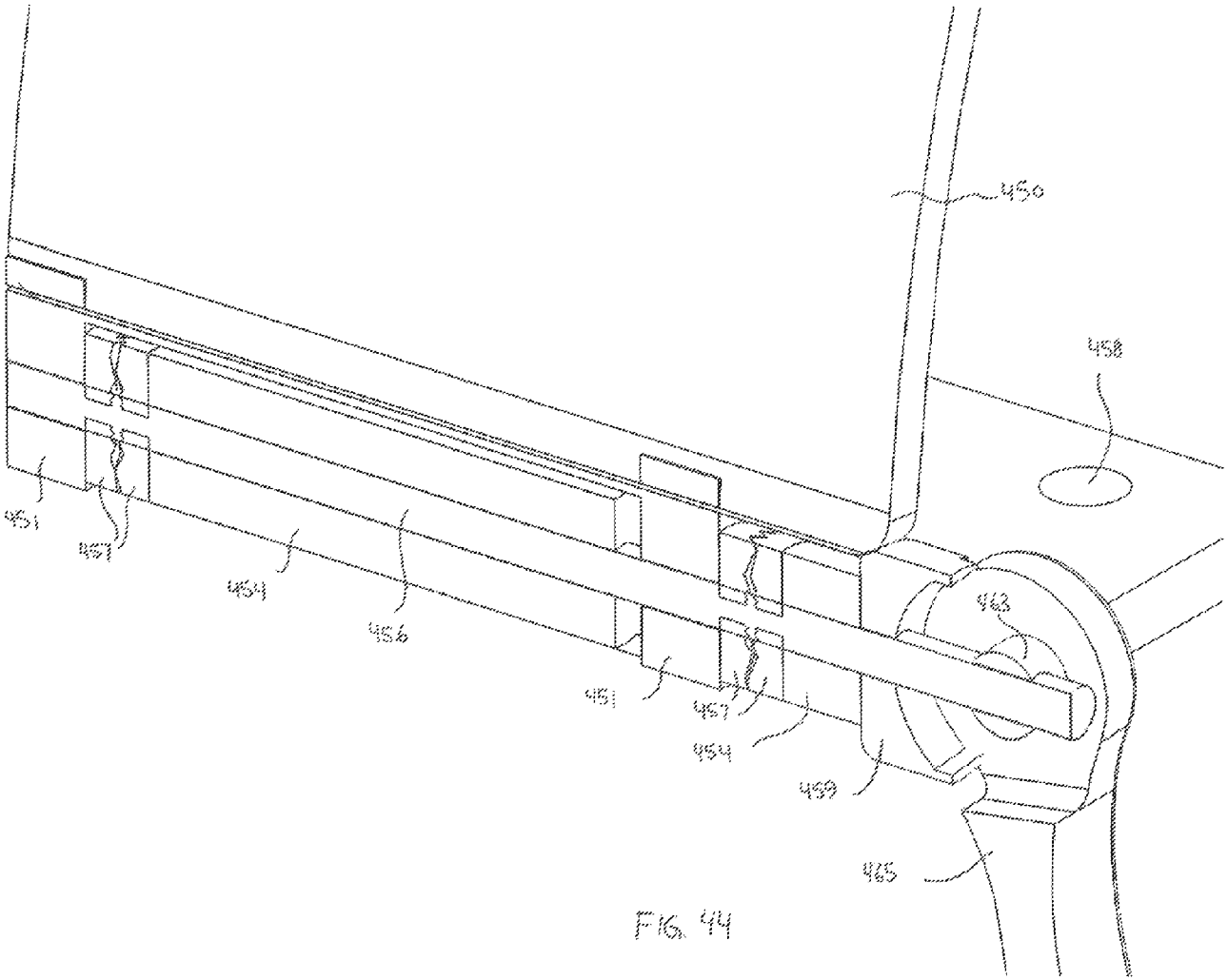
FIG. 44 is a split view of the seat bolster of the invention.

As mentioned above, a seat bolster flap, as shown in FIGS. 42, 43, 44 and others, is provided on each side of the seat to help contain or steady the legs of the user. The seat bolster flap 450 has one end thereof mounted in a groove 453 of a bolster flap base 451, which is in turn mounted on a base plate 454 attached to the seat or other structure. A pin 456 passes through holes 455 in the base plate 454 and the holes 452 in the bottom flap base 451 so that these two components are connected to each other such that they can be selectively pivoted or rotated with respect to each other in order to move the seat bolster flap 450 between an upright position in which it contains the legs, and a retracted position to permit easy access for the user, and multiple selectable positions therebetween.

Two pairs of rosettes 457 are provided and are also mounted on the pin 456. One pair is closest to the handle 465 and the other is further away. One half of each pair is mounted on the forward faces of the bolster flap base 451 while the other half of each pair is mounted to the back facing faces of the base plate 454. The pin 456 runs through the center of all the rosette pieces.

One end of the pin threadedly engages in the hole 452, while the other is treated threaded engaged with a plug 463. The plug 463 cooperates with a handle 465 including an alignment slot 466, and an arm spacer 459 is provided. It will be seen that the hole 467 in the handle 465 is not centered, but is in fact slightly off center. Therefore, as the handle 465 is rotated about the hole 467, it will have the effect of pulling or pushing the pin 456 respectively, causing engagement or disengagement respectively between the rosettes surfaces. When loosened and somewhat disengaged, the seat bolster flap 450 can be more easily pivoted and rotated out of the way. When the user, on the other hand, has placed the seat bolster flap 450 in the desired position, the handle 465 can be rotated to act on the pen 456, engage the various rosette surfaces, and prevent further rotation or pivoting of the seat bolster flap 450, until a handle is once more adjusted according to the needs and desires of the wheelchair user.

The invention is not limited to the precise details relating to structure and operation as described above. Many different embodiments for within the scope of the invention.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A wheelchair comprising:

a chassis;

a seat mounted on the chassis;

a front wheel assembly mounted on the chassis;

a pair of rear wheels mounted on the chassis; and a drive train assembly for propelling the wheelchair in a selectively forward or reverse direction, the drive train assembly comprising an arm lever which can be moved back and forth by the user, a drive member connected to the arm lever by means of a chain, and a rear wheel hub assembly connected to the drive member by means of a chain, the rear wheel hub assembly comprising a forward ramp ring and reverse ramp ring, and a pair of inner clutches for selective operative engagement with either the forward ramp ring or the reverse ramp ring.

2. A wheelchair as claimed in claim 1 wherein the chassis is generally constructed of a plurality of block pieces connected to each other by a plurality of tubes.

3. A wheelchair as claimed in claim 1 wherein the seat comprises a base, a seating surface, and a back member, the back member being pivotable relative to the base so as to facilitate folding and storage thereof.

4. A wheelchair as claimed in claim 3 wherein the back member comprises a pair of adjustable pads whose position and orientation can be adjusted to suit the physical requirements of the user.

5. A wheelchair as claimed in claim 3 further comprising a circular lock slot positioned between the base and the back, the lock slot being adjustable between the folded and unfolded position, and a lock stop operation member at the top of the back member.

6. A wheelchair as claimed in claim 3 further comprising a pair of bolsters for supporting the legs of the user, each bolster comprising a plate structure movable between a first selected and variable position for supporting the legs of the user and a second position in which each bolster is moved to a non-operational position.

7. A wheelchair as claimed in claim 1 wherein the front wheel assembly is pivotable relative to the chassis so that it is movable between a folded position for storage and transportation and an unfolded position for use of the wheelchair.

8. A wheelchair as claimed in claim 7 wherein the front wheel assembly comprises a frame member, a foot support, a pair of castor modules, and wheels attachable to the castor modules.

9. A wheelchair as claimed in claim 8 wherein each of the front wheels comprises a pair of wheels.

10. A wheelchair as claimed in claim 1 further comprising an inner clutch slider upon which the inner clutch is mounted, the inner clutch slider having a slot therein for receiving a shift pull post, the shift pull post being axially movable by operation of a cable to shift the inner clutch slider within the rear wheel hub.

11. A wheelchair as claimed in claim 10 wherein the cable extends between the shift pull post and the arm lever such that maneuvering the arm lever would result in varying the tension in the cable to move the inner clutch slider and the inner clutch so as to selectively rotate each of the rear wheels in either a forward or rearward direction.

12. A wheelchair as claimed in claim 11 wherein the rear wheel hub has associated therewith a sprocket which is connected by means of a chain to the drive member.

13. A wheelchair as claimed in claim 12 wherein the drive member has a first sprocket and a second sprocket which connects by means of a chain to the sprocket on the arm lever, and a second sprocket which connects to the sprocket on the wheel hub by means of a chain.

14. A wheelchair as claimed in claim 1 wherein the drive member comprises a torsion mechanism having a torsion housing, a pair of sprockets at each end of the torsion housing, the torsion housing being rotatably mounted on a torsion shaft, the pair of sprockets at each end of the torsion housing being respectively connected to the arm lever and the rear hub respectively.

15. A wheelchair as claimed in claim 14 wherein the torsion mechanism permits up and down movement of the rear wheels thereby imparting a suspension capability for the rear wheels.

16. A wheelchair as claimed in claim 1 wherein each of the rear wheels comprises a pair of wheel plates, the wheel plates being connected to the drive train assembly via the rear wheel hub assembly to form the center and bolted to each other at the outer edges, and a tire mounted over the outer edges.

17. A wheelchair as claimed in claim 16 wherein the wheel plates are substantially flat disk shaped structures which are spaced at an inner portion thereof at the connection to the drive train assembly and taper towards each other and connected at their outer edges.

18. A wheelchair as claimed in claim 1 further comprising a braking mechanism.

19. A wheelchair as claimed in claim 18 wherein the braking mechanism comprises a disk connected to the rear wheel hub assembly and a caliper containing brake pads for selectively engaging the disk, the brake pads being operated by a brake engagement lever.

20. A wheelchair as claimed in claim 1 wherein the seat comprises a base, a seating surface and a back member, the seating surface being ergonomically configured for the comfort of the user.

21. A wheelchair as claimed in claim 1 wherein the arm lever has a lower portion connected to the chassis, a sprocket at or near the lower portion, and an upper portion which extends above the level of the seat so as to be conveniently located for gripping by the user.

22. A wheelchair as claimed in claim 21 wherein the arm lever further comprises an inwardly directed handle at its end remote from the sprocket, and a cable extending within the arm lever from the handle to the hub assembly.

23. A wheelchair as claimed in claim 22 wherein the handles comprise rotatable gear changers, rotation of which acts on the cables to change gears formed in the wheel hub assembly.

24. A wheelchair as claimed in claim 21 wherein the upper portion of the arm lever is selectively rotatable by the user.

25. A wheelchair as claimed in claim 1 wherein the drive member comprises a torsion mechanism.

26. A wheelchair as claimed in claim 1 wherein the rear wheel hub further comprises a neutral position in which neither the forward ramp ring nor the reverse ramp ring is engaged.

27. A wheelchair as claimed in claim 1 further comprising a rotatable handle attached to the arm lever, the rotatable handle comprising a pivot joint block, an internal slider received within the joint block and having at least one lock groove, and an internal fixed locator having at least one engagement tab which releasably engages within the lock groove of the internal slider, the internal slider being axially movable between a first position wherein the tab is engaged within the lock groove and a second position wherein the tab is disengaged from the lock groove and wherein the handle can be rotated relative to the arm lever in the second position.

28. A wheelchair as claimed in claim 27 further comprising a spring operating between a spring floor on the joint block and a shoulder stop on the internal slider for moving the internal slider into the first position when the tab and lock groove are aligned.

29. A wheelchair comprising:

a chassis;

a seat mounted on the chassis;

a front wheel assembly mounted on the chassis;

a pair of rear wheels mounted on the chassis; and a drive train assembly including a forward drive gear and a reverse drive gear for propelling the wheelchair in a selectively forward or reverse direction, the drive train assembly further comprising an arm lever which can be moved back and forth by the user, a drive member connected to the arm lever by means of a first chain, and a rear wheel hub assembly connected to the drive member by means of a second chain.

* * * * *